US012622479B2

(12) United States Patent
Muskovitz

(10) Patent No.: US 12,622,479 B2
(45) Date of Patent: May 12, 2026

(54) ADJUSTABLE RETENTION SYSTEMS FOR USE WITH PROTECTIVE HELMETS AND HELMET AND ADJUSTABLE RETENTION ASSEMBLIES

(71) Applicant: RESOLUTION STRATEGIC DEVELOPMENT, INC., Park City, UT (US)

(72) Inventor: David T. Muskovitz, Park City, UT (US)

(73) Assignee: RESOLUTION STRATEGIC DEVELOPMENT, INC., Park City, UT (US)

( * ) Notice: Subject to any disclaimer, the term of this patent is extended or adjusted under 35 U.S.C. 154(b) by 0 days.

(21) Appl. No.: 18/814,296

(22) Filed: Aug. 23, 2024

(65) Prior Publication Data

US 2025/0064163 A1 Feb. 27, 2025

Related U.S. Application Data

(60) Provisional application No. 63/621,480, filed on Jan. 16, 2024, provisional application No. 63/534,319, filed on Aug. 23, 2023.

(51) Int. Cl.
*A42B 3/08* (2006.01)

(52) U.S. Cl.
CPC ..... *A42B 3/085* (2013.01)

(58) Field of Classification Search
CPC ..... A42B 3/08; A42B 3/145; A42B 3/085
See application file for complete search history.

(56) References Cited

U.S. PATENT DOCUMENTS 3,028,602 A * 4/1962 Miller ..... A42B 3/14 2/6.1
3,916,446 A 11/1975 Gooding
(Continued)

FOREIGN PATENT DOCUMENTS

CH 657024 A5 8/1986
DE 102011012972 A1 11/2012
(Continued)

OTHER PUBLICATIONS

"The Best Ballistic Helmet Chinstraps & Retention Systems", Mar. 14, 2018, 12 Pages.
(Continued)

*Primary Examiner* — Katherine M Moran
(74) *Attorney, Agent, or Firm* — Workman Nydegger

(57) ABSTRACT

Disclosed are adjustable helmet retention systems and helmet and adjustable retention assemblies that solve problems in the prior art. Specifically, disclosed are helmets and adjustable retention assemblies, including a helmet shell and an adjustable retention system that includes one or more retention straps or cables and one or more actuators. The adjustable retention system may comprise a single retention strap or cable having a chin strap subcomponent configured to engage a wearer's chin, a fit strap subcomponent configured to engage a wearer's head, including the occipital portion, and one or more actuators configured to selectively shorten or lengthen the retention strap or cable relative to the wearer's head. The adjustable retention system may alternatively comprise a separate chin strap and chin strap actuator and a separate fit strap and fit strap actuator.

20 Claims, 17 Drawing Sheets

(56) References Cited

U.S. PATENT DOCUMENTS

| | | | | |
|---|---|---|---|---|
| 4,890,338 | A | 1/1990 | Knabenhans | |
| 5,203,034 | A | 4/1993 | Foehl | |
| 5,373,588 | A | 12/1994 | Hede et al. | |
| 5,915,538 | A | 6/1999 | Basson et al. | |
| 5,983,405 | A | 11/1999 | Casale | |
| 6,256,798 | B1 | 7/2001 | Egolf et al. | |
| 6,711,751 | B1 * | 3/2004 | Muskovitz | A42B 3/12 2/10 |
| 6,934,971 | B2 | 8/2005 | Ide et al. | |
| 8,032,993 | B2 * | 10/2011 | Musal | A42B 3/145 2/418 |
| 8,438,668 | B2 | 5/2013 | Garneau et al. | |
| 9,021,616 | B2 * | 5/2015 | Baty | A42B 3/14 2/416 |
| 9,622,535 | B2 * | 4/2017 | Windham | A42B 3/145 |
| 11,089,831 | B1 | 8/2021 | Hermansen et al. | |
| 12,317,947 | B2 * | 6/2025 | Hermansen | A42B 3/32 |
| 2005/0204456 | A1 | 9/2005 | Piper et al. | |
| 2010/0170068 | A1 * | 7/2010 | Musal | A42B 3/145 24/68 D |
| 2012/0167290 | A1 | 7/2012 | Kovacevich et al. | |
| 2012/0278976 | A1 | 11/2012 | Benton | |
| 2013/0239303 | A1 | 9/2013 | Cotterman et al. | |
| 2013/0283507 | A1 | 10/2013 | Baty | |
| 2013/0312163 | A1 | 11/2013 | Van Waes | |
| 2015/0033457 | A1 | 2/2015 | Tryner et al. | |
| 2016/0165998 | A1 * | 6/2016 | Musal | A42B 3/145 2/417 |
| 2016/0174648 | A1 * | 6/2016 | Garneau | A42B 3/142 2/421 |
| 2016/0270470 | A1 * | 9/2016 | Hickman | A42B 3/08 |
| 2018/0352909 | A1 | 12/2018 | Fava | |
| 2019/0297985 | A1 | 10/2019 | Weber et al. | |
| 2020/0275723 | A1 | 9/2020 | Pritz et al. | |
| 2021/0153594 | A1 | 5/2021 | Rogers et al. | |
| 2021/0154560 | A1 | 5/2021 | Tryner et al. | |
| 2021/0251328 | A1 | 8/2021 | Roberts | |
| 2022/0015488 | A1 | 1/2022 | Adams et al. | |
| 2022/0175074 | A1 | 6/2022 | Rietdyk | |
| 2023/0180878 | A1 * | 6/2023 | Robbins | A42B 3/145 2/418 |
| 2024/0065361 | A1 * | 2/2024 | Muskovitz | A42B 3/08 |
| 2025/0000193 | A1 * | 1/2025 | Muskovitz | A42B 3/145 |
| 2025/0064164 | A1 * | 2/2025 | Muskovitz | A42B 3/145 |

FOREIGN PATENT DOCUMENTS

| | | | |
|---|---|---|---|
| EP | 0937416 | A2 | 8/1999 |
| FR | 2838611 | A1 | 10/2003 |
| WO | 2011/051989 | A1 | 5/2011 |

OTHER PUBLICATIONS

International Search Report and Written Opinion received for PCT Patent Application No. PCT/US23/72874, mailed on Nov. 16, 2023, 14 pages.

* cited by examiner

ADJUSTABLE RETENTION SYSTEMS FOR USE WITH PROTECTIVE HELMETS AND HELMET AND ADJUSTABLE RETENTION ASSEMBLIES

CROSS REFERENCE TO RELATED APPLICATION

This application claims the benefit of U.S. Provisional Application No. 63/621,480, filed Jan. 16, 2024, and U.S. Provisional Application No. 63/534,319, filed Aug. 23, 2023, which are incorporated herein by reference in their entirety.

BACKGROUND

Technical Field

This disclosure generally relates to protective helmets and, more specifically, to adjustable retention systems for use with protective helmets and helmet and adjustable retention assemblies.

Related Technology

Safety helmets are well known and may be worn when participating in a wide variety of activities. For example, helmets are typically worn to protect the wearer's head and brain during cycling, snowboarding, skiing, skateboarding, rock climbing, football, baseball, field hockey, ice hockey, horse riding, scooter riding, motorcycle riding, military action, and construction sites, just to name a few. Damage and injury can be prevented or reduced by protective headwear that prevents hard, rough, or sharp objects from coming into direct contact with a user's head. Damage and injury can also be prevented by protective headwear that absorbs and distributes the energy of an impact.

One aspect most conventional helmets share is a chin strap that connects under the wearer's chin to keep the helmet in place on the wearer's head during use. Ski and bike helmets typically include a chin strap that includes flexible webbing and a buckle that connects under the chin to selectively attach and release the chin strap. The webbing may connect to the helmet in multiple places and extend under the chin of the wearer during use. The length of the chin strap is typically adjustable via the buckle, which typically requires the wearer to remove the helmet to adjust the length. Adjustment to chin strips with under-the-neck buckles cannot be safely and effectively performed in real time, such as while the wearer is riding a bike, skiing, or engaging in sporting or other activities. Rather, such adjustments typically require the wearer to use both hands to release the buckle, adjust the strap length, and reconnect the buckle. This process may require several iterations to achieve the correct balance of comfort to the wearer and tightness for safety. Because adjusting the chin strap may be cumbersome, a wearer may decide to avoid the hassle and just "live with it", which often results in suboptimal safety and/or comfort.

The chin strap can be made of multiple pieces or parts of flexible webbing. In some helmets, a first strap is connected to the helmet behind each of the wearer's ears and a second strap is connected to the helmet in front of each of the wearer's ears. The two straps are connected together with a clasp in a Y-shaped configuration to effectively form an integrated strap. The two integrated straps may be adjustable relative to each other via the clasp to increase fit and comfort. Again, such adjustments typically require the wearer to use two hands and are performed with the helmet removed from the wearer's head.

The chin strap assists in keeping the helmet securely attached to the wearer's head. Indeed, not only do they minimize occurrences of vertical movement of the helmet being projected off of the wearer's head, but they also generally help to minimize occurrences where the helmet is pivoted off of or out of position on the front or rear portion of the wearer's head. Such off-pivoting or out-of-position alignment can expose the vulnerable part of the wearer's head to impact and injury. Thus, to ensure proper fit and safety, it is imperative for the wearer to properly adjust the tightness of the chin strap. However, for the reasons given above, a wearer may simply forgo the hassle of correctly adjusting the chin strap and instead wear the helmet with suboptimal fit, sacrificing comfort and/or safety.

Another aspect many helmets include, particular bicycle helmets, is a fit system that wraps around at least a portion of the wearer's head. The fit system can be used to provide a more customizable and comfortable fit between a generically sized helmet and the particularly sized head of a wearer. The fit system can help minimize the occurrence of unwanted movement during, including minimizing the occurrence of helmets pivoting off of or out of position on the front or rear portion of the wearer's head. Such off-pivoting or out-of-position alignment can potentially expose the vulnerable part of the wearer's head to impact and injury.

A fit system may include one or more fit straps, which can include cables, fabric, or plastic components. The fit strap can be continuous or divided into multiple pieces. The fit system includes an adjustment mechanism. The adjustment mechanism is located in the center of the fit system at the back of the occipital bun of the wearer's head. Engaging the adjustment mechanism, typically a rotatable dial, allows the wearer to selectively reduce or increase the circumference of the fit strap within the protective helmet, providing a more customized fit. The fit system is made of multiple pieces or parts of flexible or rigid material. Each section of the fit strap is connected to the adjustment mechanism at one end and to the helmet at a second end. The two second ends may be located behind the ears of the wearer. The fit system is configured so that engagement of the adjustment mechanism changes the size of the lateral offset between the two second ends. Because the adjustment happens at the occipital bun, any adjustments must be made by the wearer reaching a hand behind the wearer's head to turn the dial. This can be awkward and difficult while engaging in an activity. In some cases, the wearer must cease the activity and adjust the fit system before resuming the activity.

Helmets can undergo a series of safety tests and are required to meet certain safety standards in order to be sold on the market. Drop or impact tests generally measure how well a helmet manages energy absorption and redistribution around the wearer's head. Roll-off tests determine how well a properly fitted helmet resists being pulled down toward or away from a wearer's face. An elongation or retention test determines how well the chin strap resists stretching or breaking when a pulling force is applied to the helmet.

While conventional safety helmets may meet certain safety standards when the various straps are adjusted correctly, few users actually use them in a correctly adjusted configuration. Moreover, adjustments to the chin strap are most often done when the helmet is removed from the wearer's head, requiring trial and error to make the optimal adjustments. Even after several adjustment attempts, when the buckle of a chin strap is connected, at least one of the straps (e.g., in front of or in back of ears) may be loose, which may allow the helmet to become dislodged in the event of a crash. Furthermore, adjustment may be so cumbersome that some wearers may be unwilling to properly tighten the chin strap because the requisite level of tightness may be uncomfortable and, much of the time, the wearer may not be engaging in the most dangerous part of an activity requiring a tight chin strap. Some people may wear the helmet with unevenly adjusted chin straps and/or which are too loose, even when they are about to engage in the most dangerous part of the activity. In some cases, wearers may release the chin strap for comfort, such as while riding a ski lift or while resting in between biking intervals. Understandably, wearers sometimes forget to buckle their chin straps, which is dangerous and could lead to the helmet falling off their head. Undoubtedly, such improper fitting of conventional chin straps may cause a significant number of head trauma injuries, and in some cases, death. Approximately 30% of all injury-related deaths are a result of traumatic brain injuries.

During use of the helmet, the tightness of the fit system may also need to be adjusted by the wearer. Placement of the adjustment mechanism at the back of the head may prevent or hinder wearers from adjusting the tightness of the fit system in real time. For example, an adjustment mechanism at the back of the head can be difficult to reach while riding a bike, meaning a wearer may not be able to readily and accurately adjust the fit of their helmet in real time without awkward body contortions. The wearer my simply opt to have a sub-optimally fitting helmet for reasons given above, with the attendant risk and dangers of head trauma injury or even death.

Another problem is that, during use, chin straps, fit systems, and other webbing can become sweat-soaked and stretch or loosen. Correcting for stretching of the chin strap in real time is typically not possible as the helmet usually must be removed from the wearer's head to make any adjustments to the chin strap. And while fit systems can theoretically be adjusted in real time by turning a knob at the back of the head, the awkward positioning of the knob may deter many or most people from properly readjusting the fit system. As such, the wearer my simply opt to have a sub-optimally fitting helmet for reasons given above, with the attendant risk and dangers of head trauma injury or even death.

In view of the foregoing, there is a long-felt but unsatisfied need for improved helmet retention systems, particularly chin strap and fit retention systems, for customizing the fit of a generically sized helmet to a particular wearer.

SUMMARY

Disclosed are adjustable retention systems for use with protective helmets and helmet and adjustable retention assemblies that solve some or all of the problems of the prior art. Specifically, the adjustable retention systems include one or more retention straps configured to interface with a wearer's chin and head and one or more actuators, wherein the one or more actuators are operably connected to a respective retention strap and permit a wearer to selectively increase or decrease the length of the one or more retention straps to loosen or tighten the adjustable retention system of a helmet relative to the wearer's head.

In some embodiments, adjustable retention systems for use with protective helmets include one or more actuators in direct communication with the one or more retention straps, such that actuating or otherwise manipulating the actuator(s) selectively increases or decrease the length of the retention strap(s). In some embodiments, the one or more actuators may releasably engage the shell of a protective helmet to enable selective detachment of the one or more retention straps from the helmet during installation and removal. In some embodiments, each retention strap may comprise a substantially single continuous material extending between opposing first and second ends, or it may contain a main strap or cable with attached padding or other comfort-enhancing features. In some embodiments, at least one retention strap extends between opposing first and second ends. In other embodiments, at least one retention strap is formed into a ring or loop. The one or more actuators may comprise a detent, pawl and ratchet, spring pump, wheel, buckle, pinion gear, or other means for operably engaging, and increasing or decreasing the length of, the one or more retention straps.

In some embodiments, adjustable retention systems may comprise separate chin strap and fit strap components, which can be independently lengthened and shortened by means of dedicated chin strap and fit strap actuators to selectively tighten and loosen the chin strap and fit strap, respectively, independent of each other. For example, the chin strap can be selectively shortened or lengthened (and thereby tightened or loosened relative to a wearer's chin) by a dedicated chin strap actuator, and the fit strap can be selectively shortened or lengthened (and thereby tightened or loosened relative to a wearer's head) by a dedicated fit strap actuator.

In some embodiments, the chin strap actuator can be positioned on one side of the helmet and the fit strap actuator can be positioned on an opposite side of the helmet. In other embodiments, the chin strap and fit strap actuators can be positioned on the same side the helmet, such as being offset vertically and/or horizontally relative to each other. Alternatively, a single actuator may be configured to operably interact with both the chin strap and fit strap to selectively shorten or lengthen each simultaneously or independently. In some cases, the single actuator may be configured to engage only the chin strap in one configuration and engage only the fit strap in another configuration.

In some embodiments, adjustable retention systems may comprise a continuous retention strap comprising a chin strap subcomponent and a fit strap subcomponent, which can be lengthened and shortened by means of a single actuator to selectively tighten or loosen the retention strap, including the chin strap subcomponent and fit strap subcomponent simultaneously. In such case, tension applied to the continuous retention strap is essentially equalized between the chin strap and fit strap subcomponents. In other cases, a single actuator may be configured to selectively engage the chin strap subcomponent in one configuration and engage the fit strap subcomponent in another configuration. In such case, tension applied to the retention strap may not be equalized between the chin strap and fit strap subcomponents (e.g., due to frictional or other mechanical interference between the chin strap and fit strap subcomponents). In such case, it may alternatively be desirable to have separate chin strap and fit strap subcomponent actuators to independently shorten or lengthen the chin strap and fit strap subcomponents, respectively.

In some embodiments, when decreasing the length of the one or more retention straps, an extra length of retention strap can be housed in or received internally by the helmet. For example, the helmet may include a channel, groove, duct, and/or space in or between inner and/or outer shell components of the helmet to receive an excess portion of the retention strap(s) when shortened. In some embodiments, the inner and/or outer shell component of the helmet may include a groove or duct to receive a retention strap as it is being shortened and to guide the retention strap, for example, away from the wearer's head. In some embodiments, a retention strap may be received into a space between the inner helmet shell and the wearer's head. In this way, the retention strap may remain entirely contained within the helmet shell, with no ends of the retention strap extending out of the helmet or being externally accessible. In some embodiments, the extra length of retention strap can be external to the helmet and not contained within the shell.

In some embodiments, the adjustable retention system may comprise anchor sleeves configured to receive the opposing ends of one or more retention straps and enable quick attachment of the retention strap(s) to the helmet. In some embodiments, one or more actuators may pass through a respective anchor sleeve to engage a respective retention strap. In some embodiments, the adjustable retention system may comprise an anchor sleeve or duct to receive a middle portion of a fit strap or fit subcomponent of the retention strap, e.g., to further stabilize the helmet and secure it to the wearer's head.

In some embodiments, the adjustable retention system can include an adjustable length cable attached to webbing for comfort. In some embodiments, the adjustable length cable can be a continuous single-stranded cable having two ends and which includes both a fit strap cable subcomponent and chin strap cable subcomponent, with the first end fixed at one side of the helmet and the second end attached to the actuator at the same side of the helmet. In other embodiments, the adjustable length cable can be a multi-stranded (e.g., dual-stranded) cable that interacts with a length equalizing wheel at one side of the helmet with two ends attached at the same side of the helmet, the first end fixedly attached to the helmet and the second end attached to the actuator.

In some embodiments, the adjustable retention system can include an adjustable length retention cable that is at least partially enclosed within one or more position retention sheaths. A first retention sheath can at least partially enclose the fit strap cable subcomponent, and second and third retention sheaths can partially enclose left and right sides of the chin strap cable subcomponent The one or more position retention sheaths are configured and have a stiffness to retain an otherwise flexible and freely movable retention cable in a desired position relative to the helmet shell. The position retention sheath helps manage the location of the retention cable in order to assist the user in installing and removing the helmet by minimizing difficulties caused by unpredictable movements or positioning of an otherwise flaccid or less stiff retention cable.

In some embodiments, the helmet may comprise an inner shell component and an outer shell component. In some embodiments, the inner and outer shell components of the helmet can be joined together to create a substantially uniform helmet shell. In some embodiments, the inner and outer shell components of the helmet are formed/manufactured together as one piece. In some embodiments, the inner and outer shell components of the helmet are constructed from the same material. In some embodiments, the inner and outer shell components of the helmet are two separate and distinct pieces joined together to create the helmet. In some embodiments, the inner and outer shell components of the helmet are constructed from different materials. For example, a flexible polystyrene or other polymeric inner component can be in-molded with an outer and harder shell component.

In some embodiments, a helmet and adjustable retention assembly comprises:

- a helmet configured to at least partially cover a wearer's head, wherein the helmet includes:
  - a helmet shell, optionally an outer shell component and an inner shell component;
  - a front and a back; and
  - a left side region and a right side region; and
- an adjustable retention system including:
  - one or more retention straps configured to attach to the helmet shell and including a chin strap or chin strap subcomponent configured to engage a wearer's chin and a fit strap or fit subcomponent configured to engage a wearer's head; and
  - one or more actuators configured to attach to the left and/or right side regions of the helmet shell and be operably connected to the one or more retention straps so that actuating an actuator selectively increases or decreases a length of a corresponding retention strap in order to selectively loosen or tighten the retention strap, respectively, relative to the wearer's chin and/or head.

In some embodiments, an adjustable helmet retention system for use with a protective helmet comprises:

- one or more retention straps configured to attach to a helmet shell of the protective helmet and including a chin strap or chin strap subcomponent configured to engage a wearer's chin and a fit strap or fit subcomponent configured to engage a wearer's head; and
- one or more actuators configured to attach to the left and/or right side regions of the helmet shell and be operably connected to the one or more retention straps so that actuating an actuator selectively increases or decreases a length of a corresponding retention strap in order to selectively loosen or tighten the retention strap, respectively, relative to the wearer's chin and/or head.

In some embodiments, the adjustable retention system includes a chin strap configured to engage a wearer's chin, a fit strap configured to engage the wearer's head (e.g., at least the occipital region of the head), a chin strap actuator operably connected to the chin strap and configured to selectively shorten or lengthen the chin strap in order to selectively tighten or loosen the chin strap relative to the wearer's chin, and a fit strap actuator operably connected to the fit strap and configured to selectively shorten or lengthen the fit strap in order to selectively tighten or loosen the fit strap relative to the wearer's head.

In other embodiments, the adjustable retention system includes a single retention strap that includes a chin strap subcomponent configured to engage a wearer's chin and a fit strap subcomponent configured to engage the wearer's head, and an actuator operably connected to the retention strap and configured to selectively shorten or length the retention strap in order to selectively tighten or loosen the retention strap relative to the wearer's chin and head. In some embodiments, tension applied to the retention strap is equalized between the chin strap subcomponent and the fit strap subcomponent.

In other embodiments, an adjustable helmet retention system for use with a protective helmet comprises:

- a retention strap configured to attach to a helmet shell secure the protective helmet to wearer's head and engage the wearer's chin and head, the retention strap comprising:
  - a chin strap subcomponent configured to attach to the helmet shell, engage a wearer's chin, and having two opposing ends, a first end configured to attach to a left side region of the helmet shell and a second end configured to attach to a right side region of the helmet shell;

a fit subcomponent configured to attach to the helmet shell, engage a wearer's head, and having two opposing ends, a first end configured to attach to the left side region of the helmet shell and a second end configured to attach to the right side region the helmet shell, wherein one of the opposing ends of the chin strap subcomponent is connected to one of the opposing ends of the fit subcomponent to form the retention strap; and an actuator configured to attach to the left or right side region of the helmet shell and be operably connected to the retention strap so that actuating the actuator selectively increases or decreases a length of the retention strap in order to selectively loosen or tighten the retention strap, respectively, relative to the wearer's chin and head.

In some embodiments, an adjustable helmet retention system for use with a protective helmet comprises:

an adjustable chin strap sub-system comprising:

a chin strap configured to attach to a helmet shell, engage a wearer's chin, and having two opposing ends, a first end configured to attach to a left side region of the helmet shell and a second end configured to attach to a right side region of the helmet shell; and a chin strap actuator configured to attach to a left or right side region of the helmet shell and be operably connected to the chin strap so that actuating the chin strap actuator selectively increases or decreases a length of the chin strap in order to selectively loosen or tighten the chin strap, respectively, relative to the wearer's chin; and an adjustable fit sub-system comprising:

a fit strap configured to attach to a helmet shell, engage a wearer's head, and having two opposing ends, a first end configured to attach to the left side region of the helmet shell and a second end configured to attach to the right side region of the helmet shell; and a fit strap actuator configured to attach the left or right side region of the helmet shell and be operably connected to the fit strap so that actuating the fit strap actuator selectively increases or decreases a length of the fit strap in order to selectively loosen or tighten the fit strap, respectively, relative to the wearer's head.

In some embodiments, the one or more actuators may comprise a slider, detent, spring pump, ratchet system, wheel, pinion gear, or other means for selectively increasing or decreasing the length of the one or more retention straps. The one or more actuators can be releasably or non-releasably attached to a left side region and/or a right side region of the helmet shell. Alternatively, the actuator can be attached to a truss of a truss pair near a side region of the helmet shell, with first and second trusses being rigidly or rotatably connected to and extending downwardly from respective left and right side regions of the helmet shell.

In some embodiments, the adjustable retention system may comprise tethers configured to enable proper geometric placement of the one or more retention straps on the wearer's head and chin and provide a more comfortable fit. In some embodiments, the tethers are connected to the one or more retention straps via anchor fittings. In other embodiments, the tethers may be integral with the one or more retention straps.

In some embodiments, the retention strap may comprise a single continuous retention strap with no buckle or other attachment feature configured to be positioned adjacent to a wearer's chin and/or occipital portion of the wearer's head.

In some embodiments, the helmet and adjustable retention assembly may comprise one or more linear gears connected to or that form part of the one or more retention straps. The one or more linear gears can be positioned in or adjacent to the left or right side region of the helmet shell. The one or more actuators may comprise one or more pinion gears configured to engage the one or more linear gears such that selectively rotating the one or more actuators in a first direction shortens the one or more retention straps and rotating the one or more actuators in an opposite direction lengthens the one or more retention straps in order to selectively tighten or loosen the one or more retention straps relative to the wearer's chin and head.

In some embodiments, the one or more actuators can be removably attached to the helmet shell such that removal of the one or more actuators detaches the end of the retention strap(s) operably connected to the actuator(s) from the helmet shell and facilitates installation and removal of the helmet to and from the wearer's head. Additionally, or alternatively, an end of the retention strap(s) opposite to the end(s) attached to the actuator(s) can be removably attached to the helmet shell such that detaching that end of the retention strap(s) from the helmet facilitates installation and removal of the helmet to and from the wearer's head. In some embodiments, the one or more actuators may include a lock configured to temporarily lock the actuator(s) and prevent changes in the length of the retention strap(s) while locked.

This summary is provided to introduce a selection of concepts in a simplified form that are further described below in the detailed description. This summary is not intended to identify key features or essential features of the claimed subject matter, nor is it intended to be used as an indication of the scope of the claimed subject matter.

BRIEF DESCRIPTION OF THE DRAWINGS

Various objects, features, characteristics, and advantages of the invention will become apparent and more readily appreciated from the following description of the embodiments, taken in conjunction with the accompanying drawings and the appended claims, all of which form a part of this specification. In the Drawings, like reference numerals may be utilized to designate corresponding or similar parts in the various Figures, and the various elements depicted are not necessarily drawn to scale, wherein:

DETAILED DESCRIPTION

Figure 1A:
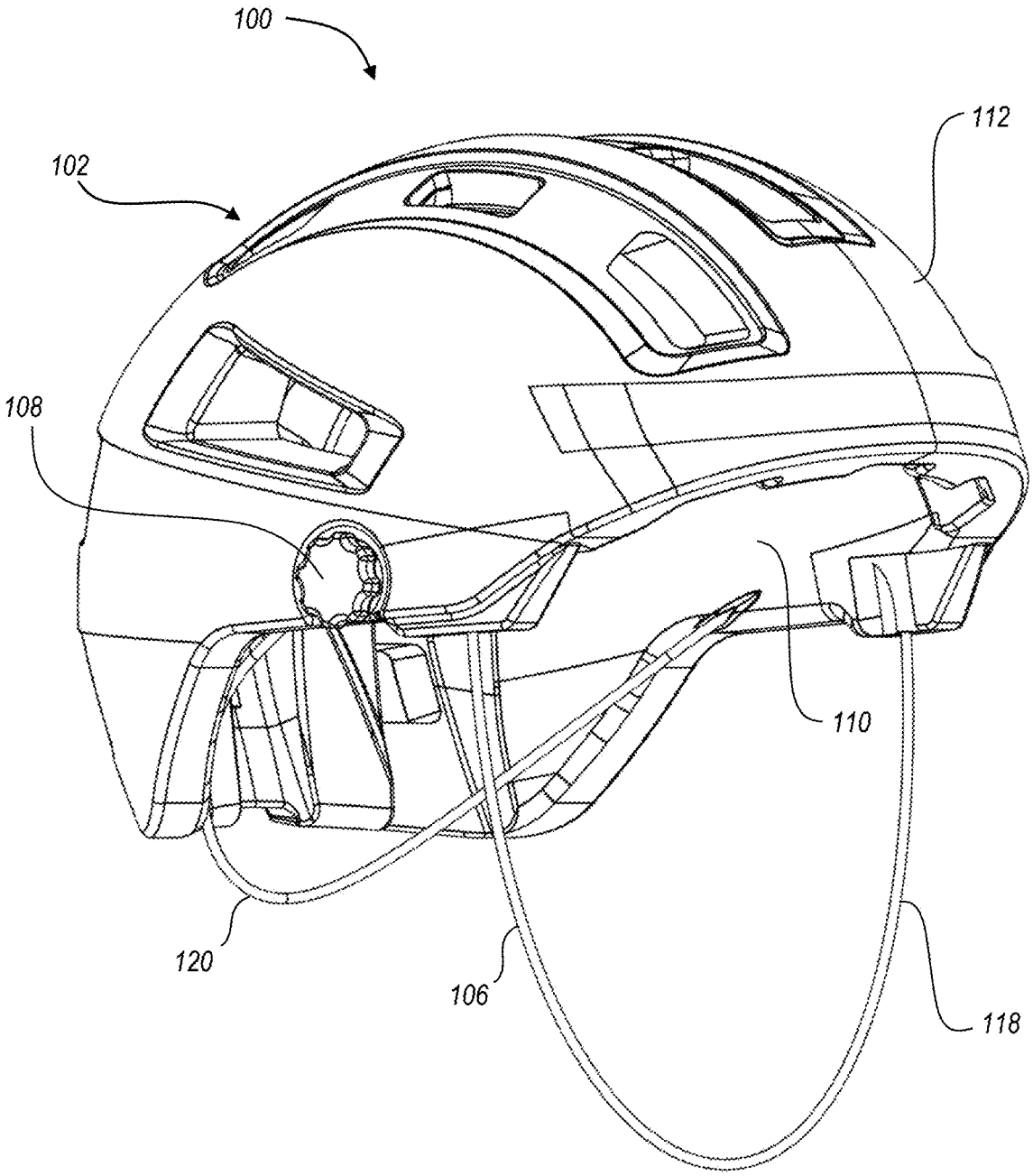
FIG. 1A schematically illustrates an embodiment of a helmet and adjustable retention assembly, which includes a single-stranded adjustable retention cable.

Disclosed are adjustable retention systems for use with protective helmets and helmet and adjustable retention assemblies that solve some or all of the problems of the prior art. Specifically, the adjustable retention systems include one or more retention straps configured to interface with a wearer's chin and head and one or more actuators, wherein the one or more actuators are operably connected to a respective retention strap and permit a wearer to selectively increase or decrease the length of the one or more retention straps to loosen or tighten the adjustable retention system of a helmet relative to the wearer's head The one or more retention straps cleanly and simply connect to the helmet shell. In some embodiments, each retention strap may comprise two opposing ends which are anchored to the same or opposite side of the helmet shell. In some embodiments, the retention strap may comprise a continuous loop a portion of which may be anchored to a side of the helmet shell. In some embodiments, one or more additional portions of the retention strap may be anchored to the helmet shell.

In some embodiments, adjustable retention systems may comprise separate chin strap and fit strap components, which can be independently lengthened and shortened by means of dedicated chin strap and fit strap actuators to selectively tighten and loosen the chin strap and fit strap, respectively, independent of each other. For example, the chin strap can be selectively shortened or lengthened (and thereby tightened or loosened relative to a wearer's chin) by a dedicated chin strap actuator, and the fit strap can be selectively shortened or lengthened (and thereby tightened or loosened relative to a wearer's head) by a dedicated fit strap actuator.

In some embodiments, adjustable retention systems may comprise a continuous retention strap comprising a chin strap subcomponent and a fit strap subcomponent, which can be lengthened and shortened by means of a single actuator to selectively tighten or loosen the retention strap, including the chin strap subcomponent and fit strap subcomponent simultaneously. In such case, tension applied to the continuous retention strap is essentially equalized between the chin strap and fit strap subcomponents. In other cases, a single actuator may be configured to selectively engage the chin strap subcomponent in one configuration and engage the fit strap subcomponent in another configuration. In such case, tension applied to the retention strap may not be equalized between the chin strap and fit strap subcomponents (e.g., due to frictional or other mechanical interference between the chin strap and fit strap subcomponents). In such case, it may alternatively be desirable to have separate chin strap and fit strap subcomponent actuators to independently shorten or lengthen the chin strap and fit strap subcomponents, respectively.

In some embodiments, adjustable retention systems for use with protective helmets include one or more actuators in direct communication with the one or more retention straps, such that actuating or otherwise manipulating the actuator(s) selectively increases or decrease the length of the retention strap(s). In some embodiments, the one or more actuators may releasably engage the shell of a protective helmet to enable selective detachment of the one or more retention straps from the helmet during installation and removal. In some embodiments, each retention strap may comprise a substantially single continuous material extending between opposing first and second ends, or it may contain a main strap or cable with attached padding or other comfort-enhancing features. In some embodiments, at least one retention strap extends between opposing first and second ends. In other embodiments, at least one retention strap is formed into a ring or loop. The one or more actuators may comprise a detent, pawl and ratchet, spring pump, wheel, buckle, pinion gear, or other means for operably engaging, and increasing or decreasing the length of, the one or more retention straps.

In some embodiments, the one or more actuators are operably connected to the one or more retention straps, such that actuating or otherwise manipulating an actuator can quickly and easily increase or decrease the length of a corresponding retention strap in real time, such as while the wearer is riding a bike, skiing, or engaging in other sporting events or activities, to achieve optimal comfort, tightness, and fit. In some embodiments, the one or more actuators may releasably engage the helmet shell to enable the one or more retention straps to releasably engage the helmet shell to facilitate installation and removal of the helmet from the wearer's head. In other embodiments, a first end of a retention strap opposite to a second end of the retention strap engaged with a corresponding actuator may releasably engage the helmet shell.

The helmet is configured to at least partially cover a wearer's head. In some embodiments, the helmet may comprise an inner shell component and an outer shell component. In some embodiments, the inner and outer shell components of the helmet can be joined together to create a substantially uniform helmet shell. In some embodiments, the inner and outer shell components of the helmet are formed/manufactured together as one piece. In some embodiments, the inner and outer shell components of the helmet are constructed from the same material. In some embodiments, the inner and outer shell components of the helmet are two separate and distinct pieces joined together to create the helmet. In some embodiments, the inner and outer shell components of the helmet are constructed from different materials. For example, a flexible polystyrene or other polymeric inner component can be in-molded with an outer and harder shell component.

The helmet shell may include a channel, comprising a groove, conduit, space, or duct configured to receive a portion of a retention strap. In some embodiments, an inside surface of the outer shell component of the helmet can include a channel configured to receive a portion of the retention strap as it is being shortened, and to guide the portion of the retention strap, for example, away from the wearer's head. In some embodiments, an outside surface of the inner shell component of the helmet can include a channel to receive the portion of the retention strap as it is being shortened to guide the retention strap, for example, away from the user's head. In some embodiments, a retention strap can be received into a channel comprising a space between the inner and outer shell components. In some embodiments, the retention strap can be received into a channel comprising a space between the shell and the user's head. In this way, the retention strap may remain entirely contained within the helmet, with no ends of the retention strap extending out of the helmet or being externally accessible. In some embodiments, the extra length of the retention strap can be external to the helmet and not contained within the shell. In some embodiments, the extra length of the retention strap may be configured to be grasped and pulled by the wearer to easily tighten the retention strap. The extra length of the retention strap may comprise a mechanism, such as a loop or a tag having a tactile surface, to facilitate grasping of the extra length by the wearer.

In some embodiments, both ends of the one or more retention straps may be removably or non-removably connected to the helmet shell. In some embodiments, both ends of a retention strap can be removably or non-removably anchored between the inner and outer shell components of the shell. In some embodiments, both ends of the retention strap can be removably or non-removably anchored to the inner shell component. In some embodiments, both ends of the retention strap can be removably or non-removably anchored to the outer shell component of the helmet shell. In some embodiments, the retention strap can be one continuous strap extending between left and right side regions of the helmet shell, the retention strap being adjustable in length via the actuator without any portion being detached. In another embodiment, an end of the retention strap may comprise prongs, barbs, or similar mounting hardware to enable selective insertion and retention of the end of the retention strap in the helmet shell. This insertion and retention may be permanent in nature or may be reversible to allow for the quick detachment of the retention strap from the helmet shell.

To install or remove the helmet, the wearer can simply lengthen the one or more retention straps until the helmet can fit over the wearer's head unhindered by the one or more retention straps. After installing the helmet with the loosened strap(s), the wearer can then shorten (tighten) the retention strap(s) using the actuator(s) to achieve a comfortable and sufficiently secure fit.

In some embodiments, only one end of the one or more retention strap may be non-removably anchored to the shell. For example, the anchored end of a retention strap may be anchored between the inner and outer shell components of the helmet shell. Alternatively, the anchored end may be anchored to one of the inner or outer shell components of the helmet shell. Alternatively, the anchored end may be anchored to one of the inner or outer shell components of the helmet shell. The other end can be engageable with the shell (the inner component, the outer component, or both) and can be removed from the shell to have a free hanging retention strap end (still anchored by the other end). For example, a first end connected to a fit strap portion of the retention strap may be detachably anchored to the helmet shell and the second end connected to the chin strap portion of the retention strap may be non-removably anchored to the helmet shell. Alternatively, a first end connected to the fit strap portion of the retention strap may be non-removably anchored to the helmet shell and the second end connected to the chin strap portion of the retention strap may be detachably anchored to the helmet shell. In some embodiments, the detachable end of the retention strap may removably attach to the shell via the actuator. In other embodiments the detachable end of the retention strap may removably engage with the shell via a buckle, snap, or other connection feature, with the non-removeable end being attached to the helmet shell via the actuator.

In some embodiments, the one or more actuators may removably engage with the helmet shell via a buckle, snap, or bar-type engagement. The buckle, snap, or bar-type engagement feature may be attached to the inner shell component, the outer shell component, or both, or it may be attached to the chin portion of the retention strap at or near a left or right side region of the helmet shell. Each actuator can be in communication with an end of a corresponding retention strap to selectively increase or decrease the length of the retention strap. When the actuator and free/removable end of the retention strap are disengaged from the helmet shell, the retention strap may retain the length previously set by adjusting the actuator. Beneficially, a user may quickly detach the one or more actuators and one or more retention straps to remove the helmet. The user may similarly quickly attach the one or more actuators and one or more retention straps to the helmet shell without having to adjust the length or fit of the one or more retention straps. Beneficially, this helps ensures that a wearer can retain a properly fitting helmet, reducing traumatic brain and head injuries.

In some embodiments, the adjustable retention system may comprise multiple sub-systems, such as an adjustable chin strap sub-system and an adjustable fit strap sub-system. The adjustable chin strap sub-system may include a first actuator and a chin strap that cleanly and simply connects to the helmet shell, with two opposing ends of the chin strap being anchored, in some embodiments, to opposite sides of the helmet shell, with the chin strap being configured to engage a bottom of a wearer's chin to secure the helmet to the wearer's head. The first actuator may be operably connected to the chin strap, such that actuating or otherwise manipulating the actuator can quickly and easily increase or decrease the length of the chin strap relative to the left and right side regions of the helmet shell in order to selectively loosen or tighten the chin strap. The adjustable fit strap sub-system may include a second actuator and a fit strap that cleanly and simply connects to the helmet shell, with two opposing ends of the fit strap being anchored, in some embodiments, to opposite sides of the helmet shell, with the fit strap being configured to at least partially encircle a rear or occipital portion of the wearer's head, such that by shortening (tightening) the fit strap the wearer's head is pulled against a front inner surface of the helmet shell and/or a front portion of the fit strap. The second actuator may be operably connected to the fit strap, such that actuating or otherwise manipulating the actuator can quickly and easily increase or decrease the length of the fit strap in order to selectively loosen or tighten the fit strap relative to the wearer's head. In some embodiments, the first actuator of the adjustable chin strap sub-system may be positioned on the left or right side region of the helmet shell and the second actuator of the adjustable fit strap sub-system may be positioned on a side region of the helmet shell opposite the first actuator.

Embodiments of the present disclosure provide a number of benefits, technical solutions, and advantages over prior art helmets and retention systems. For example, the disclosed adjustable retention systems and helmet and adjustable retention assemblies enable more accurate and easy adjustment of the one or more retention straps and more accurate or proper fit for the wearer. Adjustments can be made quickly and easily using one hand and without having to remove the helmet. This permits real time adjustments while engaging in an activity. Providing an accurate and proper fit beneficially leads to a decrease in both head trauma injuries and the severity of any head trauma injuries. For example, a 66% decrease of serious head injuries may be realized by a proper helmet fit.

Also beneficially, a more accurate and proper fit provides a more comfortable fit, meaning the user is more likely to wear the helmet during dangerous activities or during more dangerous parts of some activities. Further, the disclosed adjustable retention systems and helmet and adjustable retention assemblies are applicable across a wide variety of helmet types, such as construction, bicycle, ski and snowboard, team sports (e.g., American football, hockey, or lacrosse helmets), and motorcycle helmets, among others. Further, the adjustable retention systems can be contained inside and about the helmet, beneficially providing a cleaner and more aerodynamic profile. Additionally, there are no external parts to get caught or dragged while wearing and using the helmet.

A further benefit is the modular characteristics of the disclosed adjustable retention systems. The adjustable retention systems may be embedded into or connected to various helmets. Thus, differing helmet shapes and styles may be quickly assembled with copies of the same adjustable retention system, facilitating the manufacturing and assembly processes. This modularity also allows users to assemble the adjustable retention system in various helmet shells, and it allows users to develop a level of comfort with their system without needing to learn how to use a new system each time they select a new helmet shell.

Reference will now be made to the Figures, which illustrate embodiments of helmet and adjustable retention assemblies, and adjustable retention systems configured for use with a helmet, that facilitate adjustment of the length and fit of the one or more retention straps via one or more readily accessible actuators on one or more side regions of the helmet that can advantageously be manipulated using one hand. It shall be understood that the Figures are illustrative only and not limiting. In addition, features shown in one Figure can be used in combination with features from one or more other Figures without limitation as long as such combination is operable and useful to achieve the purposes disclosed herein. Thus, any feature shown in one Figure can provide enabling disclosure when combined with any feature from one or more Figures.

FIG. 1A illustrates an embodiment of a helmet and adjustable retention assembly 100 of the present disclosure. The helmet and adjustable retention assembly 100 includes a helmet shell 102 and an adjustable retention system 104, which includes a retention strap or retention strap cable 106 and an actuator 108. The retention strap includes a chin strap subcomponent 118 and a fit strap subcomponent 120. The adjustable retention system 104 is schematically illustrated as including a single-stranded retention strap or retention strap cable 106, which can be advantageously enclosed within webbing, and/or woven material (e.g. cotton, polyester, or a blend) for comfort. However, it shall be understood that the adjustable retention system 104 can simply include a single component retention strap or retention strap cable 106 that does not include or is not in the form of a cable. In either case, the retention strap or single-stranded retention strap cable 106 is fixed at one side of the helmet shell 102 and attached to the actuator 108 at the same side of the helmet shell 102.

The helmet shell 102 may include an inner shell component 110 and an outer shell component 112. In some embodiments, the outer shell component 112 can be a relatively hard, rigid layer and the inner shell component 110 can be a softer liner attached or joined to the outer shell component 112. In some embodiments, the inner shell component 110 may include a harness or suspension system configured to comfortably engage the wearer's head. In some embodiments, the inner shell component 110 may include foam, fabric, and/or padding. In some embodiments, the helmet shell 102 may further include a lining (not shown) that attaches and provides additional padding to the inner shell component 110. In some embodiments, the inner shell component 110 can be directly attached or bound to the outer shell component 112, such as by in-molding, in order for the inner and outer shell components to form a composite system that reinforces each other. In some embodiments, there can be a gap or space between the inner and outer shell components 110, 112, such as to receive a portion of the retention strap or retention strap cable 106.

In some embodiments, both the inner and outer shell components 110, 112 are molded and thermoformed into a desired shape. In some embodiments, the inner and outer shell components 110, 112 can be in-molded together as a composite piece. In other embodiments, the inner and outer shell components 110, 112 can be formed separately and then joined together to create the helmet shell 102. For example, the outer shell component 112 can be molded and thermoformed into a desired shape, and the inner shell component 110 can then be in-molded within the outer shell component 112 or separately molded and then attached to the outer shell component 112. In some embodiments, the outer shell component 112 is solid and continuous (such as with a construction hard hat). In some embodiments, the outer shell component 112 includes vents or gaps (such as with a bicycle or ski helmet).

Figure 2:
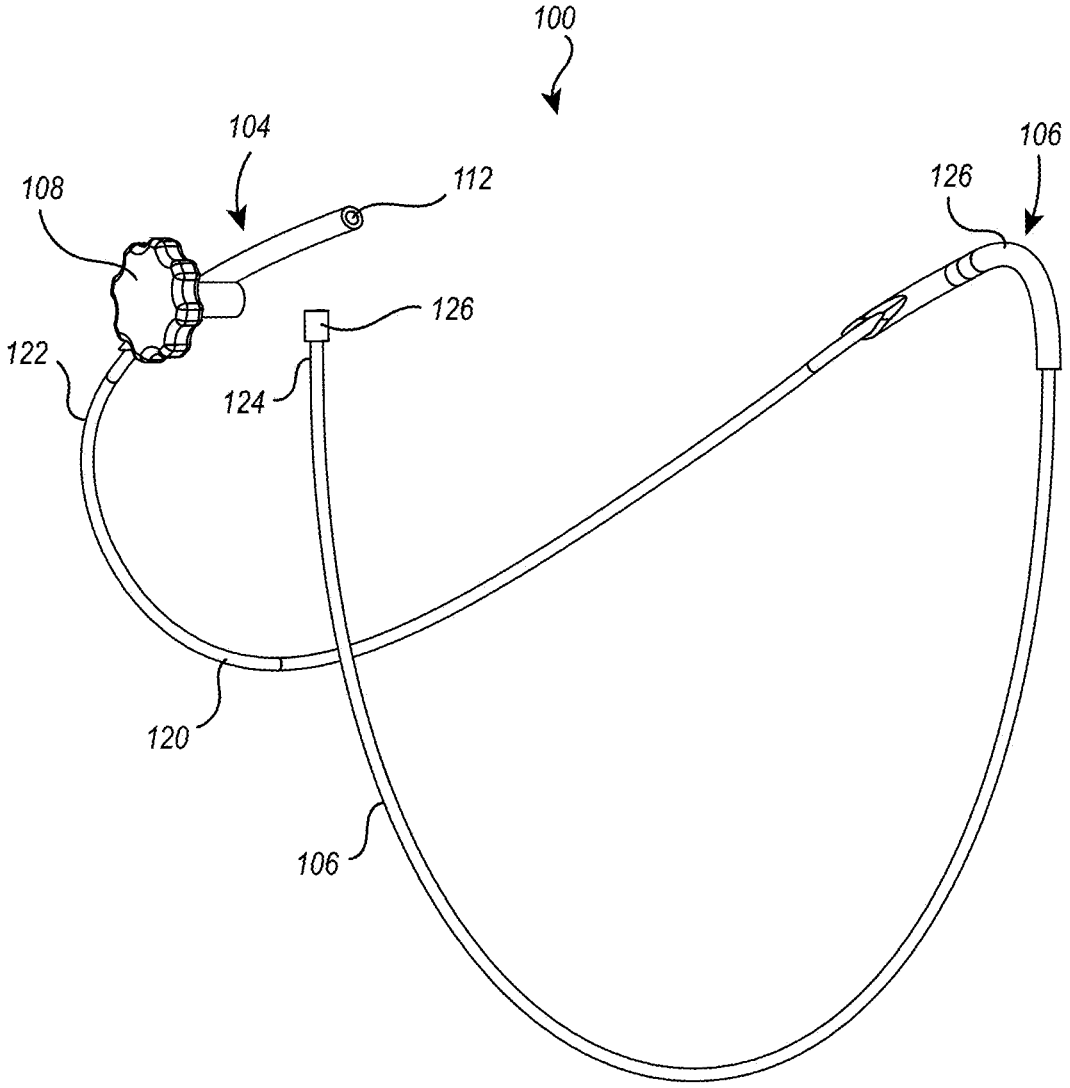
FIG. 2 schematically illustrates an embodiment of an adjustable helmet retention system.
Figure 3:
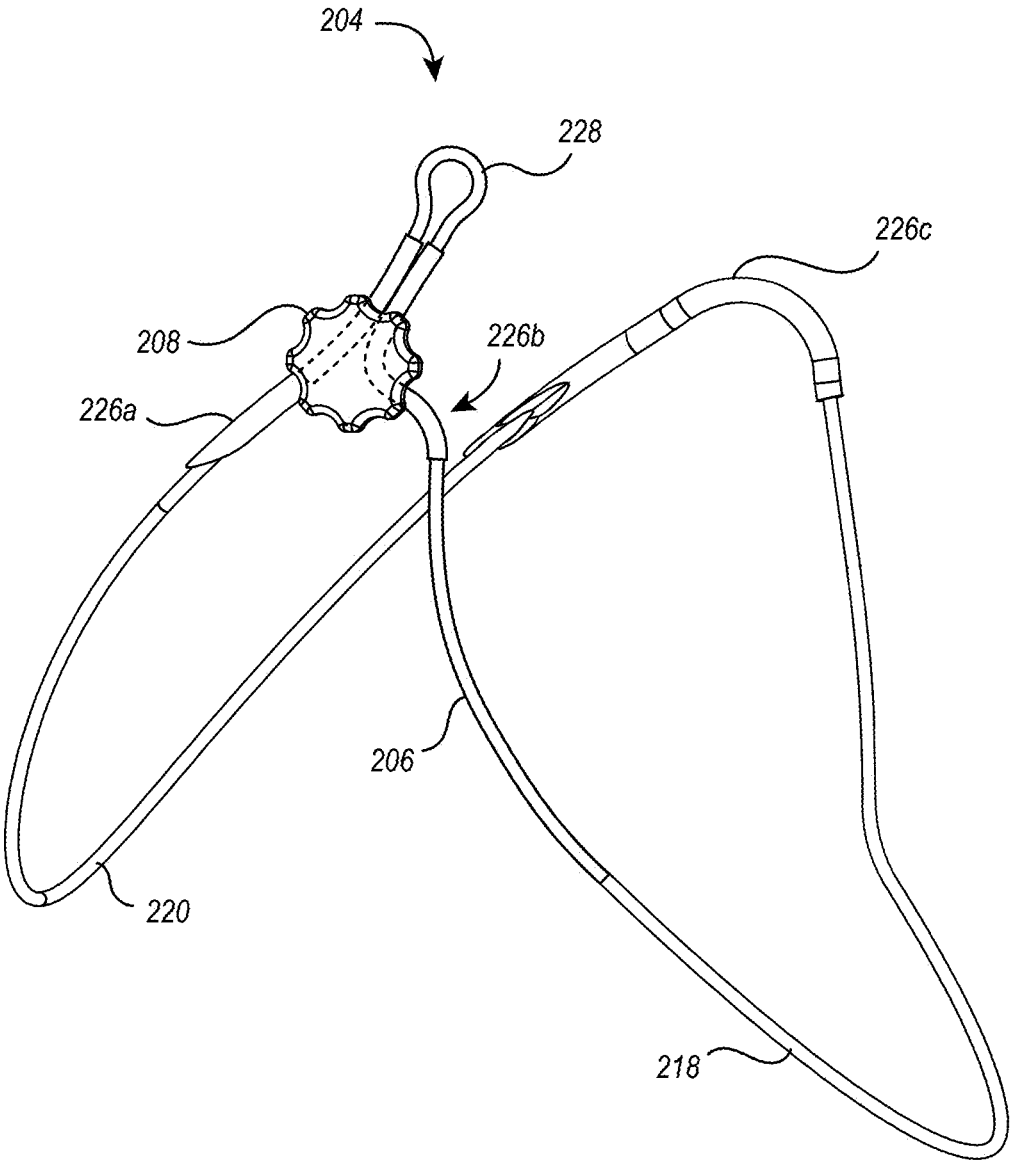
FIG. 3 schematically illustrates another embodiment of an adjustable helmet retention system.

The adjustable retention system 104 includes a retention strap or retention strap cable 106 and an actuator 108. As illustrated, the actuator 108 can be side-accessible and easy to reach and manipulate, thereby enabling ready adjustment of the length and tightness of the retention strap or retention strap cable 106 relative to a wearer's head and chin. For example, the actuator 108 may be positioned at or near a left or right side region or a left or right ear area of the helmet shell 102. The actuator 108 may be a slider, detent, spring pump, pawl, ratchet system, wheel, pinion gear, or other means for selectively increasing or decreasing the length of the retention strap or retention strap cable 106. As seen in FIGS. 1-3, the actuator 108 may comprise a wheel having a gear-like profile to facilitate manipulation of the actuator 108 by the wearer. In some embodiments, the actuator 108 may comprise a tactile surface, such as a surface comprising bumps or an abrasive material. Alternatively, or additionally, the actuator 108 may comprise knurling or scalloping to facilitate manipulation of the actuator 108 by the wearer.

Rotation of the actuator 108 in a first direction tighten the retention strap or retention strap cable 106, and rotation of the actuator 108 in a second direction opposite the first direction loosens the retention strap or retention strap cable 106. In some embodiments, the actuator 108 may comprise a first position wherein the actuator 108 engages the retention strap or retention strap cable 106 to tighten or loosen the retention strap or retention strap cable 106. In some embodiments, the actuator 108 may be configured to be moved to a second position wherein the actuator 108 engages the retention strap or retention strap cable 106 and is configured to tighten or loosen the retention strap or retention strap cable 106 at a different rate than the actuator 108 when in the first position. For example, the actuator 108 may be configured to provide gross adjustment of the retention strap or retention strap cable 106 when in the first position and provide fine adjustment of the retention strap or retention strap cable 106 when in the second position. Alternatively, or additionally, the actuator 108 may be configured to be moved to a third position wherein the actuator 108 is not engaged with the retention strap or retention strap cable 106, such that a portion of the retention strap or retention strap cable 106 may move freely within the channel. Such a retention system 104 may facilitate quick removal of the helmet and adjustable retention assembly 100 by the wearer. In some embodiments, the helmet and adjustable retention assembly 100 may include multiple actuators 108, such as a first and second actuator, the first actuator providing gross adjustment of the retention strap or retention strap cable 106 and the second actuator providing fine adjustment of the retention strap or retention strap cable 106.

In some embodiments, both ends of the retention strap or retention strap cable 106 can be non-removably anchored to or between the inner and outer shell components 110, 112 of the helmet shell 102. Specifically, in some embodiments the retention strap or retention strap cable 106 may only be adjustable in length via the actuator 108. To install or remove the helmet and adjustable retention assembly 100, a wearer can simply lengthen the retention strap or retention strap cable 106 until the helmet shell 102 and retention strap or retention strap cable 106 can fit over and around the wearer's head, the retention strap or retention strap cable 106 encircling a back portion of the wearer's head. After initially installing the helmet shell 102 over the wearer's head, the wearer can shorten (tighten) the retention strap or retention strap cable 106 via the actuator 108 to achieve a comfortable and properly secure fit. The actuator 108 may be accessed on a side region of the helmet shell 102—either at approximately a left-ear area or approximately a right ear area (as shown). In some embodiments, the left and/or right ear areas encompass a left and/or right ear perimeter of the helmet shell 102 as well as the ear of the wearer.

The helmet shell 102 may include one or more channels, comprising a groove, conduit, or space configured to receive a portion of the retention strap or retention strap cable 106. A channel may receive an end of the retention strap or retention strap cable 106 and may be configured to receive an extra portion of retention strap or retention strap cable 106 to accommodate shortening of the retention strap or retention strap cable 106. A channel may receive a middle portion 116 of the retention strap or retention strap cable 106 to guide the retention strap or retention strap cable 106 through a side portion of the helmet shell 102 and over the ear of the wearer.

Figure 1B:
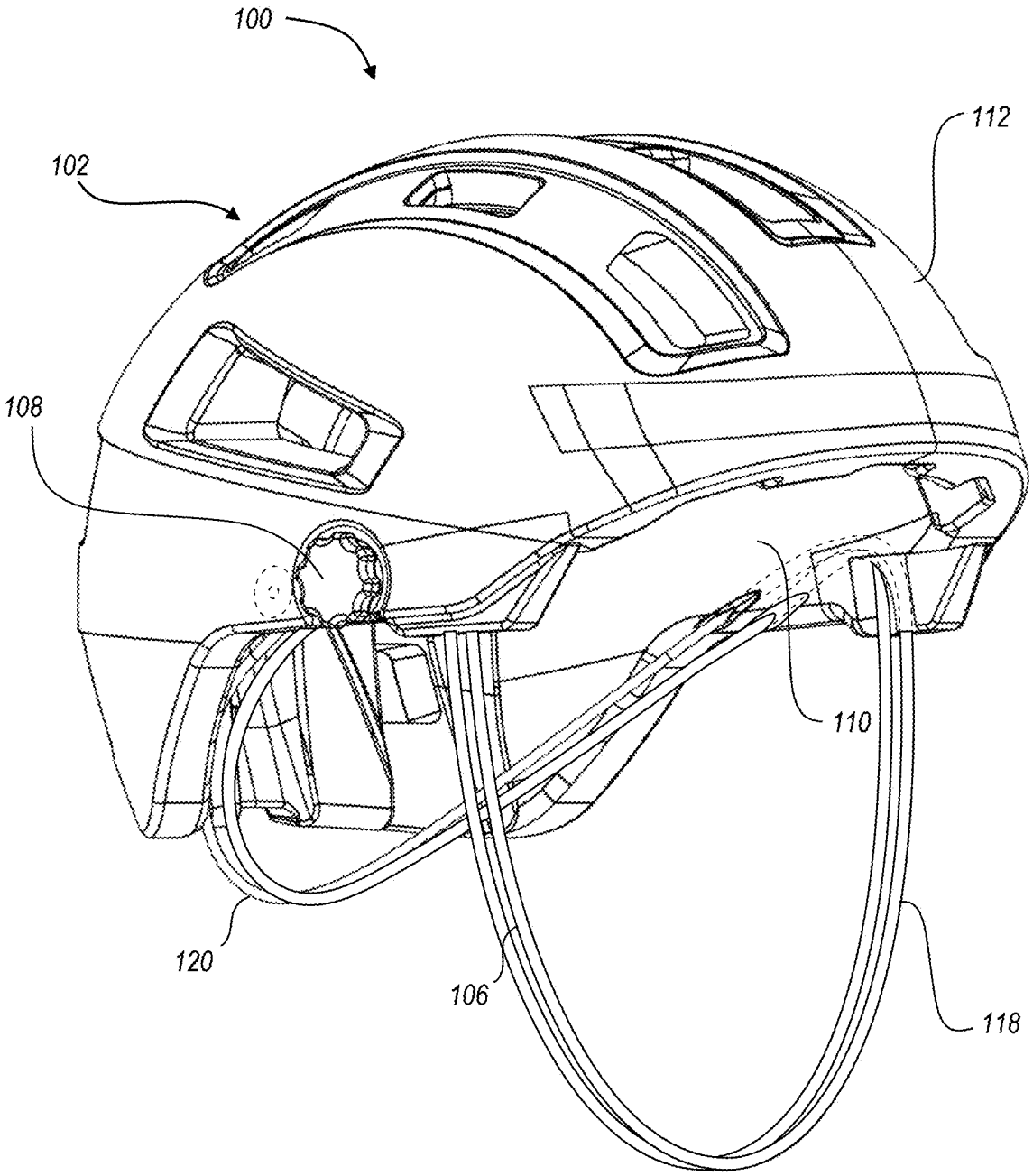
FIG. 1B schematically illustrates an embodiment of a helmet and adjustable retention assembly, which includes a dual-stranded adjustable retention cable.

FIG. 1B illustrates an alternative embodiment of a helmet and adjustable retention assembly 100 of the present disclosure, but in which adjustable retention assembly 104 includes a dual-stranded adjustable retention strap or retention strap cable 106, which can be advantageously enclosed within webbing, and/or woven material (e.g. cotton, polyester, or a blend) for comfort. The dual-stranded retention strap or retention strap cable 106 interacts with a length equalizing wheel 109 at a side of the helmet shell 102, with two ends attached at the same side of the helmet shell 102. One end of the dual-stranded retention strap cable 106 is fixed to the helmet by an anchor sleeve (not shown) and the other end is attached to the actuator 108, which permits the user to selectively shorten or lengthen the dual-stranded retention strap cable 106.

The dual-stranded retention strap cable 106 in this embodiment functions much like a double pully to reduce the force required to turn the actuator to tighten the dual-stranded retention strap cable 106, which may permit more fine tuning of fit strap tightness by the user. Assuming the actuator 108 has the same configuration or length-altering diameter or ratio as in FIG. 1A, it would take twice as many turns of the actuator 108 to shorten or lengthen the dual-stranded retention strap cable 106. Of course, the actuator 108 can be altered to have a different length-altering diameter or ratio, such that fewer turns are required to shorten or lengthen the dual-stranded retention strap cable 106, as desired.

FIG. 2 illustrates an exemplary embodiment of the adjustable retention system 104 of FIG. 1. The adjustable retention system 104 comprises a single continuous retention strap or retention strap cable 106 and an actuator 108. In some embodiments, the retention strap or retention strap cable 106 is of monolithic construction, wherein the material may comprise a semi-rigid cable. In another embodiment, the retention strap or retention strap cable 106, again of monolithic construction, may comprise a flexible material and may exhibit elastically deformable properties. In another embodiment, the retention strap or retention strap cable 106 may comprise woven materials. In some embodiments, the retention strap or retention strap cable 106 may be a combination of the above-described materials or comprised of similar materials. Portions of the retention strap or retention strap cable 106 may comprise padding, webbing, or otherwise soft materials to limit irritation to the wearer. Other portions of the retention strap or retention strap cable 106 may comprise semi-rigid or flexible materials to aid in its manipulation through the channels and maintain mechanical engagement with the actuator 108.

The retention strap or retention strap cable 106 comprise a chin strap subcomponent 118 and a fit strap subcomponent 120. The chin strap subcomponent 118 of the retention strap or retention strap cable 106 may be configured to at least partially encircle a wearer's jaw, such that tightening of the retention strap or retention strap cable 106 shortens the chin strap subcomponent 118 of the retention strap or retention strap cable 106 and pull the helmet shell 102 against the top of the wearer's head. The fit strap subcomponent 120 of the retention strap or retention strap cable 106 may be configured to at least partially encircle a wearer's head, such that tightening of the retention strap or retention strap cable 106 shortens the fit strap subcomponent 120 of the retention strap or retention strap cable 106 and urge the wearer's head against a front inner surface of the helmet shell 102 and/or a front surface of the fit strap subcomponent 120. Thus, actuating the actuator 108 may be used to selectively tighten or loosen the retention strap or retention strap cable 106 and thereby tighten or loosen the chin strap subcomponent 118 and/or the fit strap subcomponent 120 of the retention strap or retention strap cable 106.

In some embodiments, the retention strap or retention strap cable 106 may comprise two opposing end portions, including a first end portion 122 connected to the fit strap subcomponent 120 of the retention strap or retention strap cable 106 and a second end portion 124 connected to the chin strap subcomponent 118 of the retention strap or retention strap cable 106. The actuator 108 may be operably connected to either the first end portion 122 or the second end portion 124 of the retention strap or retention strap cable 106 to selectively tighten or loosen the retention strap or retention strap cable 106. An end of the retention strap or retention strap cable 106 opposite the end connected to the actuator 108 may comprise prongs, barbs, or similar mounting hardware to enable selective insertion and retention of the end of the retention strap or retention strap cable 106 in the helmet shell 102. This insertion and retention may be permanent in nature or may be reversible to allow for the quick detachment of the retention strap or retention strap cable 106 from the helmet shell 102.

In some embodiments, the adjustable retention system 104 may comprise one or more anchor sleeves 126 configured to anchor the retention strap or retention strap cable 106 to the helmet shell 102 and/or to facilitate free and easy movement of the retention strap or retention strap cable 106, such that tightening or loosening of the fit strap subcomponent 120 may cause a corresponding tightening or loosening of the chin strap subcomponent 118. The anchor sleeves 126 may also be configured to facilitate anchoring of the retention strap or retention strap cable 106 to the helmet shell 102. In some embodiments, the anchor sleeves 126 may be one-way push-to-connect type sleeves, where an end of the retention strap or retention strap cable 106 is inserted into the anchor sleeve 126, engaged with the anchor sleeve 126, and cannot be pulled out of the anchor sleeve 126. The anchor sleeves 126 may be a detent-type slot, where a pin on one end of the retention strap or retention strap cable 106 engages with a hole in the anchor sleeve 126. To remove the end of the retention strap or retention strap cable 106, the wearer would simply push the pin through the hole and pull on the retention strap or retention strap cable 106. In some embodiments, an anchor sleeve 126 may be configured to receive a first or second end portion 122, 124 of the retention strap or retention strap cable 106, having sufficient internal volume to receive an extra length of first or second end portion 122, 124 during tightening of the retention strap or retention strap cable 106 and a another anchor sleeve 126 may be configured to receive the second end portion 124 of the retention strap or retention strap cable 106. The actuator 108 may be configured to pass through the anchor sleeve 126 to engage the first end portion 122 of the retention strap or retention strap cable 106. The adjustable retention system 104 may also comprise yet another anchor sleeve 126 configured to receive a middle portion 116 of the retention strap or retention strap cable 106.

FIG. 3 illustrates an alternative exemplary embodiment of an adjustable retention system 204. The adjustable retention system 204 comprises a retention strap 206, an actuator 208, and three anchor sleeves, including a first anchor sleeve 226*a*, a second anchor sleeve 226*b*, and a third anchor sleeve 226*c*. The retention strap 206 may comprise a continuous loop, having a chin strap subcomponent 218 and an fit strap subcomponent 220. In some embodiments, the retention strap 206 may be non-slidably secured to a helmet shell 102 by one of the first or second anchors sleeves 226*a*, 226*b*, with the retention strap 206 slidably anchored to the other anchor sleeve of the first or second anchor sleeves 226*a*, 226*b*, wherein the actuator 208 may pass through the other anchor sleeve to engage the retention strap 206, the actuator 208 functioning to secure the tightness of the retention strap 206. In some embodiments, the retention strap 206 may be slidably secured to the third anchor sleeve 226*c*. The retention strap 206 may also comprise an extra length portion 228 configured to receive or provide an extra length of retention strap 206 when tightening or loosening the retention strap 206, respectively.

Figure 4:
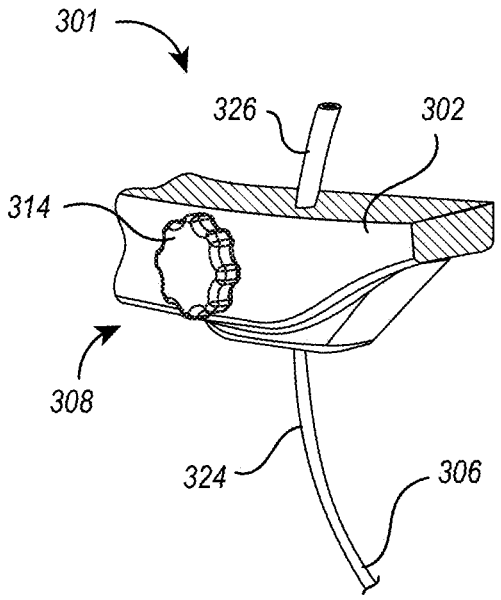
FIG. 4 schematically illustrates a portion of an adjustable helmet retention system comprising a wheel-type actuator.

FIGS. 4-7 illustrate various exemplary embodiments of the actuator 108 that can be used with the adjustable retention systems 104, 204 discussed above. FIG. 4 illustrates a portion 301 of an exemplary helmet and adjustable retention assembly, comprising an actuator 308, a portion of a helmet shell 302, a second end portion 324 of a retention strap 306, and an anchor sleeve 326 configured to receive the second end portion 324 of the retention strap 306. The actuator 308 is side-accessible and easy to reach and manipulate, thereby enabling ready adjustment of the length of the retention strap 306. For example, the actuator 308 may be positioned at or near a left or right side region, or a left or right ear area of the helmet shell. As illustrated, the actuator 308 may comprise a wheel 314 having a gear-like profile to facilitate manipulation of the actuator 308 by the user. In some embodiments, the actuator 308 may comprise a tactile surface, such as a surface comprising bumps or an abrasive material. Alternatively, or additionally, the actuator 308 may comprise knurling or scalloping to facilitate manipulation of the actuator 308 by a wearer. In other embodiments, the actuator 308 may also comprise various mechanisms for shortening (tightening) the retention strap 306.

In some embodiments, the actuator 308 may be at least partially embedded in the helmet shell 302, such as sandwiched between inner and outer shell components. In other embodiments, the actuator 308 may be embedded in a housing (described below). If the actuator 308 is embedded in helmet shell 302 or housing, a portion of the actuator 308 can be accessible to the wearer.

Figure 5:
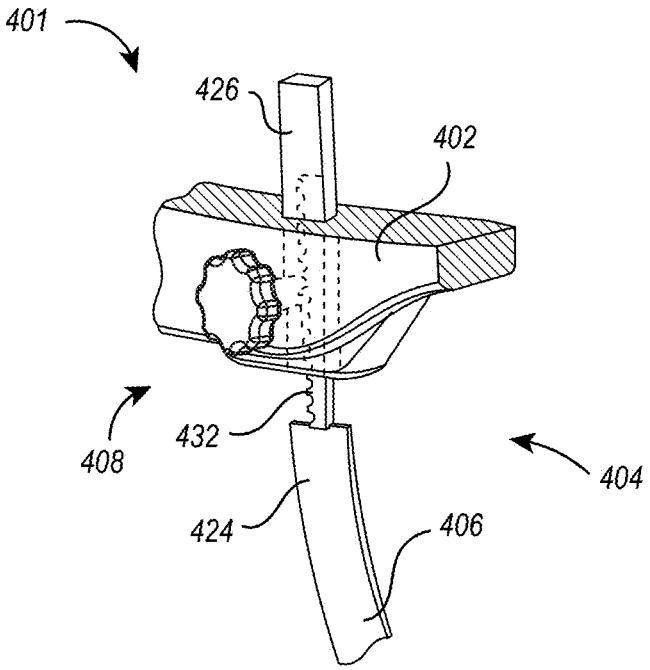
FIG. 5 schematically illustrates a portion of another adjustable helmet retention system comprising a wheel-type actuator with a pinion gear and a retention strap with a linear gear.

FIG. 5 illustrates a portion 401 of an exemplary helmet and adjustable retention assembly, including a retention strap 406 having a second end portion 424, a portion of the helmet shell 402, an anchor sleeve 426 configured to receive the second end portion 424 of the retention strap 406, and an actuator 408 comprising a wheel 414. The second end portion 424 of the retention strap 406 may be positioned in or adjacent to a left side region or a right side region of the helmet shell 402. A linear gear 432 may be attached to or form part of the second end portion 424 of the retention strap 406, and which may be received by an anchor sleeve 426 of the adjustable retention system 404. The actuator 408 may comprise a pinion gear or other mechanism which passes through the anchor sleeve 426 and engage the linear gear 432 of the retention strap 406, such that rotation of the actuator 408 in a first direction tightens the retention strap 406 and rotation of the actuator 408 in a second direction opposite the first direction loosens the retention strap 406. In some embodiments, the second end portion 424 of the retention strap 406 may comprise one linear gear 432 configured to be engaged by the pinion gear of the actuator 408.

In some embodiments, the actuator 408 may comprise two or more positions for gross and fine adjustment in a manner similar to that described above. For example, in some embodiments the second end portion 424 of the retention strap 406 may comprise two or more linear gears 432, such as a first linear gear and a second linear gear, the first and second linear gears being disposed upon the same portion of the retention strap 406. The actuator 408 may also comprise a first pinion gear configured to engage the first linear gear and a second pinion gear configured to engage the second linear gear. The first linear gear may comprise coarser teeth being separated by a first distance (i.e., a gap between the teeth of the linear gear configured to receive the teeth of the corresponding pinion gear) and the second linear gear may comprise finer teeth being separated by a second distance, the first distance being greater than the second distance. The adjustable fit system 404 may then be configured such that the first pinion gear of the actuator 408 engages the first linear gear of the retention strap 406 when in the first position, and the second pinion gear of the actuator 408 engages the second linear gear of the retention strap 406 when in the second position, the actuator 408 providing gross adjustment of the retention strap 406 when in the first position and fine adjustment of the retention strap 406 when in the second position.

Figure 6:
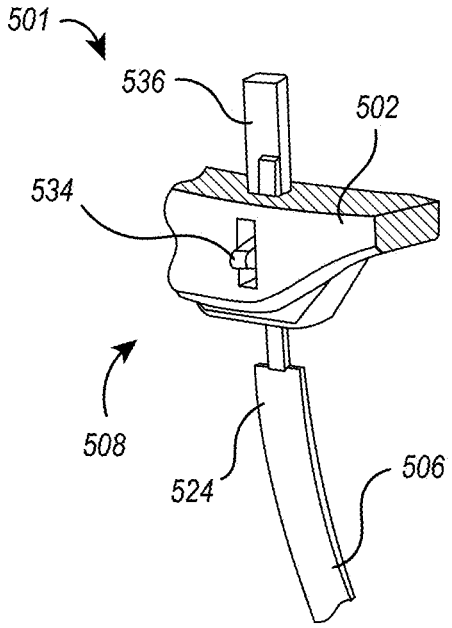
FIG. 6 schematically illustrates a portion of another adjustable helmet retention system comprising a slider-type actuator.

FIG. 6 illustrates a portion 501 of an exemplary helmet and adjustable retention system assembly, comprising an actuator 508, a portion of a helmet shell 502, a retention strap 506 having a second end portion 524, and an anchor sleeve 536 disposed within the helmet shell 502 and configured to receive the second end portion 524 of the retention strap 506. The actuator 508 comprises a slider 534 attached to or forming a part of the second end portion 524 of the retention strap 506, such that the retention strap 506 may be tightened or loosened by manipulating the position of the slider 534, which can be achieved by moving the slider 534 in a first direction or in a second direction opposite the first direction. The slider 534 and/or second end portion 524 of the retention strap 506 may be configured to frictionally or otherwise engage the anchor sleeve 536 or helmet shell 502 such that the anchor sleeve 536 or helmet shell 502 functions to hold the retention strap 506 in the position set by the wearer. In some embodiments, at least a portion of the slider 534 may be embedded in the helmet shell 502. In such embodiments, at least a portion of the slider 534 will be accessible to the wearer to adjust the tightness of the retention strap 506.

Figure 7:
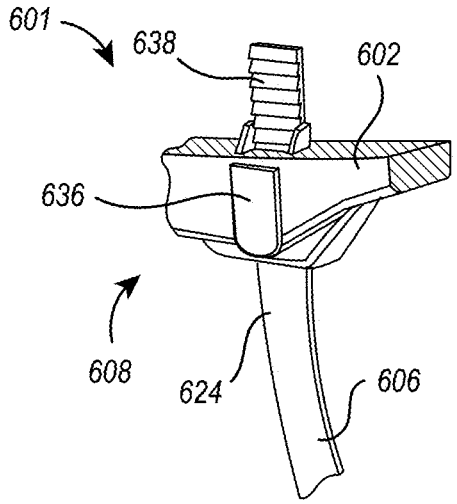
FIG. 7 schematically illustrates a portion of another adjustable helmet retention system comprising a buckle-type actuator.

FIG. 7 illustrates a portion 601 of another exemplary helmet and adjustable retention system assembly comprising a retention strap 606 having a second end portion 624, a portion of the helmet shell 602, and an actuator 608. The actuator 608 may comprise a buckle-type actuator 608, comprising a buckle 636 configured to engage a buckle catch 638 that is attached to or forms a part of the second end portion 624 of the retention strap 606, similar to the micro buckles of a ski boot. The buckle 636 engages the buckle catch 638 to either tighten or loosen the retention strap 606. In some embodiments, the retention strap 606 may be tightened by pushing the second end portion 624 of the retention strap 606 past the actuator 608 to attain the desired tightness, the buckle 636 engaging the buckle catch 638 to prevent the loosening of the retention strap 606. In some embodiments, the retention strap 606 may be loosened by pressing the buckle 636 and pulling on a portion of the retention strap 606. In some embodiments, the buckle 636 is at least partially embedded in the helmet shell 602. In such embodiments, at least a portion of the buckle 636 will be accessible to the wearer to adjust the tightness of the retention strap 606.

Figure 8:
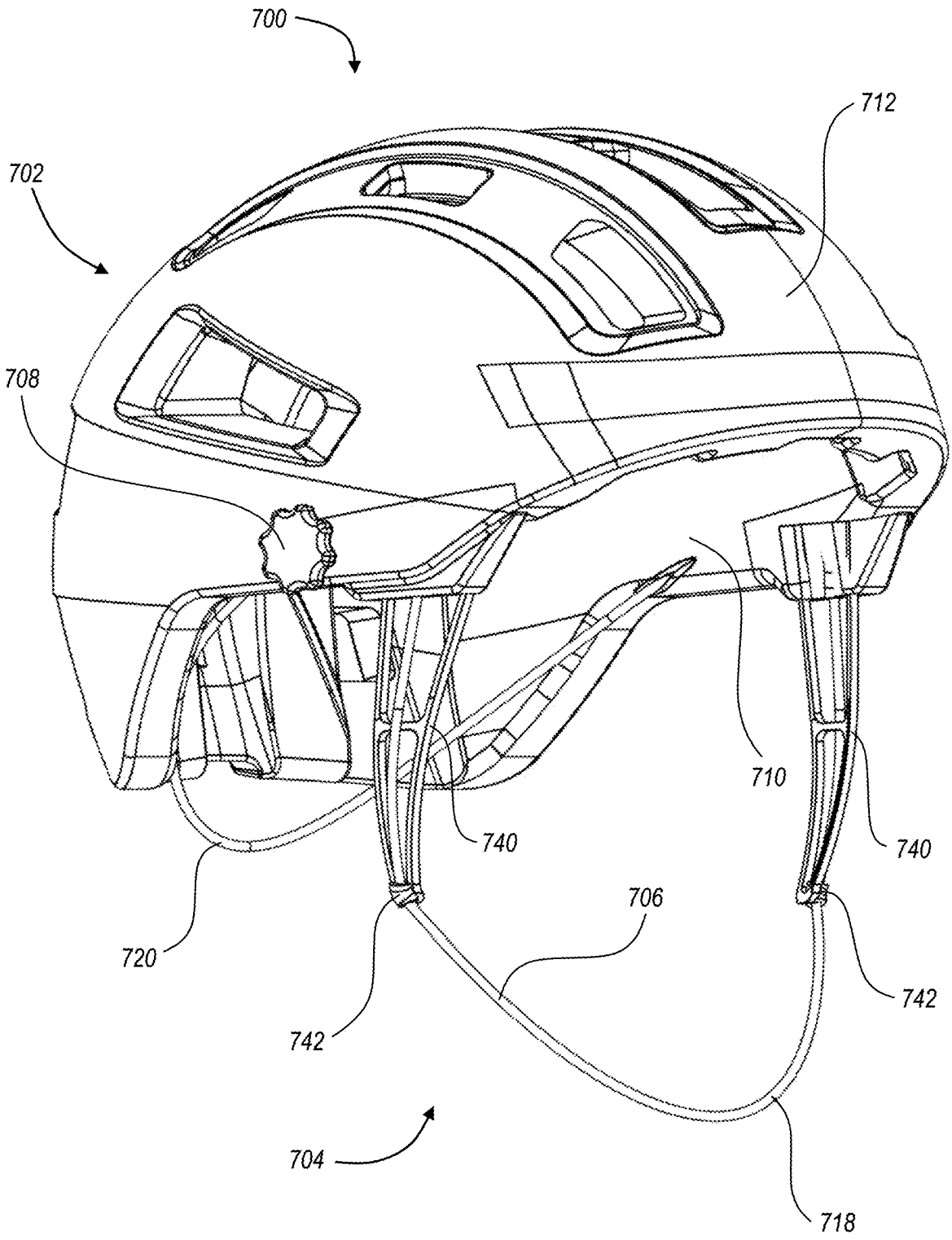
FIG. 8 schematically illustrates another embodiment of a helmet and adjustable retention assembly.

FIG. 8 illustrates an embodiment of a helmet and adjustable retention assembly 700, comprising a helmet shell 702 having an inner shell component 710 and an outer shell component 712, and an adjustable retention system 704, comprising a retention strap 706 having a chin strap subcomponent 718 and a fit strap subcomponent 720, an actuator 708, and a truss pair 740. Specifically, FIG. 8 shows the truss pair 740 attached and/or anchored to the helmet shell 702 at an upper portion of the left and right ear areas, respectively. The truss pair 740 is configured to maintain left and right side portions of the chin strap subcomponent 718 in a desired position to facilitate ease of use to the wearer. In some embodiments, the truss pair 740 and may be of a rigid material. In some embodiments, the truss pair 740 may comprise a material with inherent spring-like properties to allow for the truss pair 740 to deflect from their resting position and maintain a curved position when under the tension of strap. The truss pair 740 may extend downward and away from the helmet shell 702 at the left and right ear areas. The left and right ear areas may encompass a left and right ear perimeter of the helmet shell 702, respectively, as well as a at least a portion of the truss pair 740.

Figure 9:
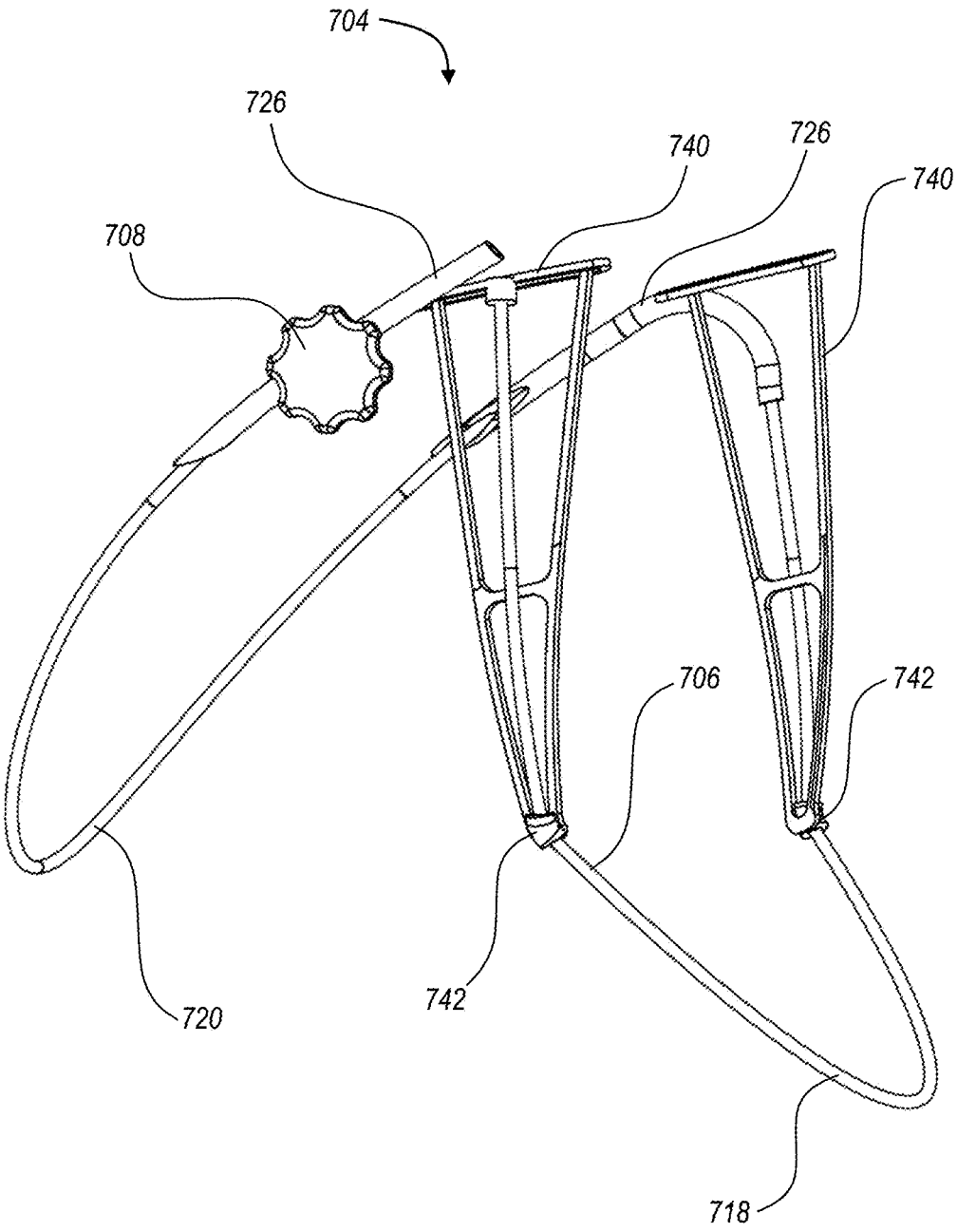
FIG. 9 schematically illustrates another embodiment of an adjustable helmet retention system comprising a truss pair.

FIG. 9 illustrates the adjustable retention system 704 of the assembly 700 of FIG. 8, comprising the truss pair 740. The truss pair 740 may be made of the same material as the helmet shell 702 or may be made from a more flexible material. In some embodiments, the truss pair 740 may be in-molded to the left and right ear areas, at the inner shell component 710, at the outer shell component 712, or between the inner and outer shell components 710, 712 of the helmet shell 702. In some embodiments, the truss pair 740 may be attached to the left and/or right ear areas after the helmet shell 702 has been constructed. In some embodiments, the truss pair 740 may be pivotably attached to the helmet shell 702.

The truss pair 740 may include an anchor fitting 742 configured to receive a portion of the retention strap 706. The anchor fitting 742 may be similar to or substantially the same as the anchor sleeves 726 (see FIGS. 2-3). The retention strap 706 may be inserted through the anchor fitting 742 and truss pair 740 and into the shell 702. In some embodiments, the anchor fitting 742 of each truss of the truss pair 740 may retain the chin strap subcomponent 718 of the retention strap 706 in place and prevent it from rotating and/or sliding around during use of the helmet 700. In some embodiments, the anchor fitting 742 of each truss of the truss pair 740 may provide a hinge point about which the chin strap subcomponent 718 may pivot or rotate. In some embodiments, the anchor fitting 742 can be slidable along the chin strap subcomponent 718 to aid in adjusting the comfort and fit of the adjustable retention system 700. In some embodiments, the opposing ends of the retention strap 706 may engage with additional anchor sleeves 726 (not shown) positioned between the inner and outer components 710, 712, of the shell 702. One or both of the additional anchor sleeves 726 may have a curvature following the curvature of the helmet shell 702. In another embodiment, the retention strap 706 may be retained by the truss pair 740 by means of loops or clips along the length of each truss. The retention strap 706 would then be selectively fed through the loops or engaged by the clips by the user allowing for easy replacement of the retention strap 706.

Though not illustrated, in some embodiments, the actuator 708 may be attached to a portion of the truss pair 740 at or near a left or right side portion rather than to the helmet shell 702 itself. In this configuration, the actuator 708 may still communicate with the retention strap 706 at or near a left or right side portion of the helmet shell 702 and enable the wearer to easily increase and/or decrease the length of the retention strap 706 in real time.

The truss pair 740 beneficially provides support for the chin strap subcomponent 718 of the retention strap 706, increasing the safety of the helmet 700 and comfort for the user. Beneficially, the truss pair 740 may obviate the need for rear straps or webbing behind the ear, which are typically used in conventional helmets and can be uncomfortable to the wearer (e.g., by pushing or rubbing against the wearer's ears). In some embodiments, the retention system 704 may further include a lock. The lock may be engaged to lock the actuator 708 to prevent a change in the length of the retention strap 706. Such lock may beneficially maintain the predetermined length of the retention strap 706 during high intensity activities, such as alpine skiing/snowboarding or rock climbing.

Figure 10:
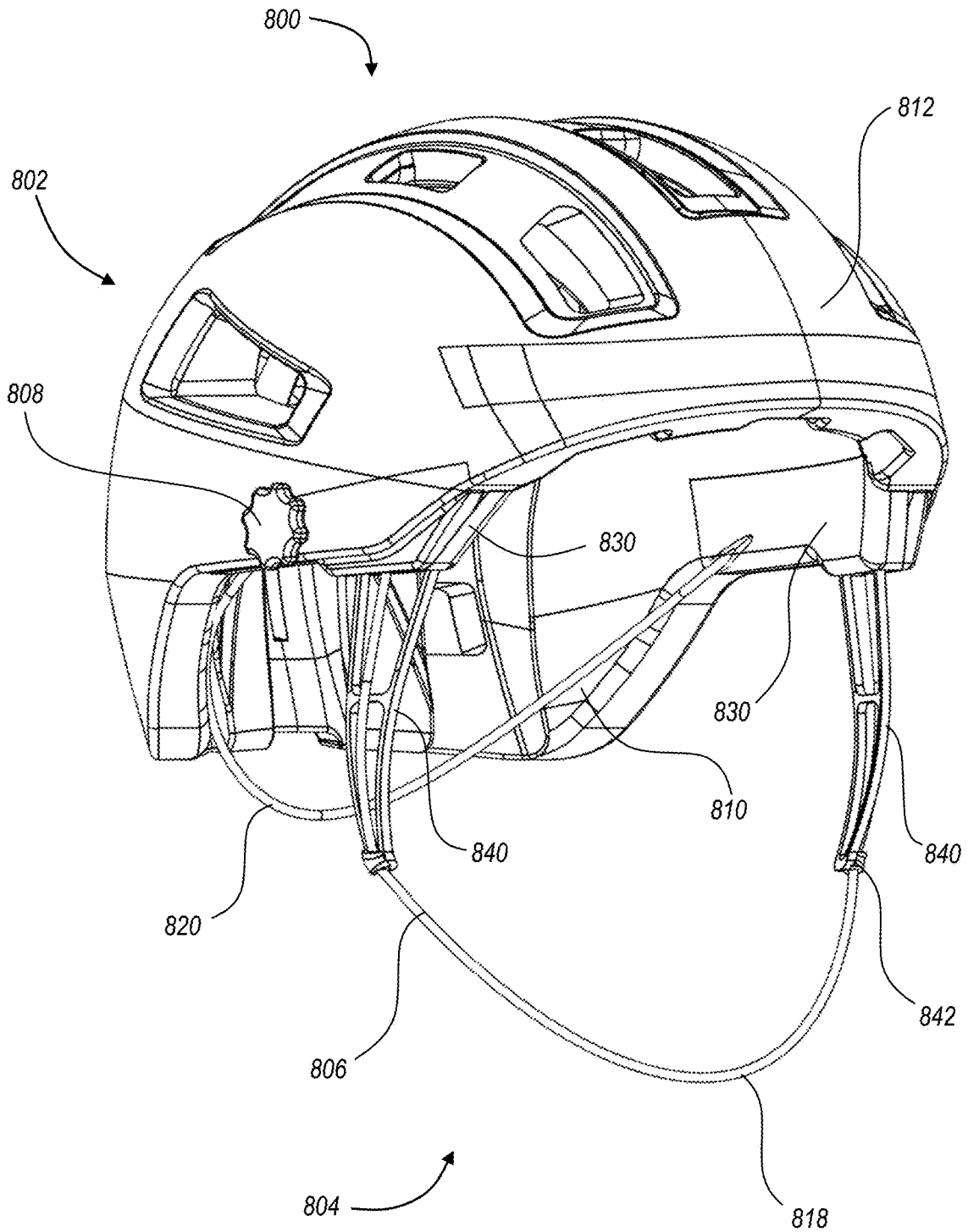
FIG. 10 schematically illustrates another embodiment of a helmet and adjustable retention assembly.

FIG. 10 illustrates an embodiment of a helmet and adjustable retention assembly 800, comprising a helmet shell 802 having an inner shell component 810 and an outer shell component 812 and an adjustable retention system 804. The adjustable retention system 804 comprises a retention strap 806 having a chin strap subcomponent 818 and an fit strap subcomponent 820, an actuator 808, and one or more housings 830 configured to facilitate assembly of the adjustable retention system 804 with the helmet shell 802. Specifically, the adjustable retention system 804 may be constructed with the housings 830 before assembling the adjustable retention system 804 with the helmet shell 802.

Figure 11:
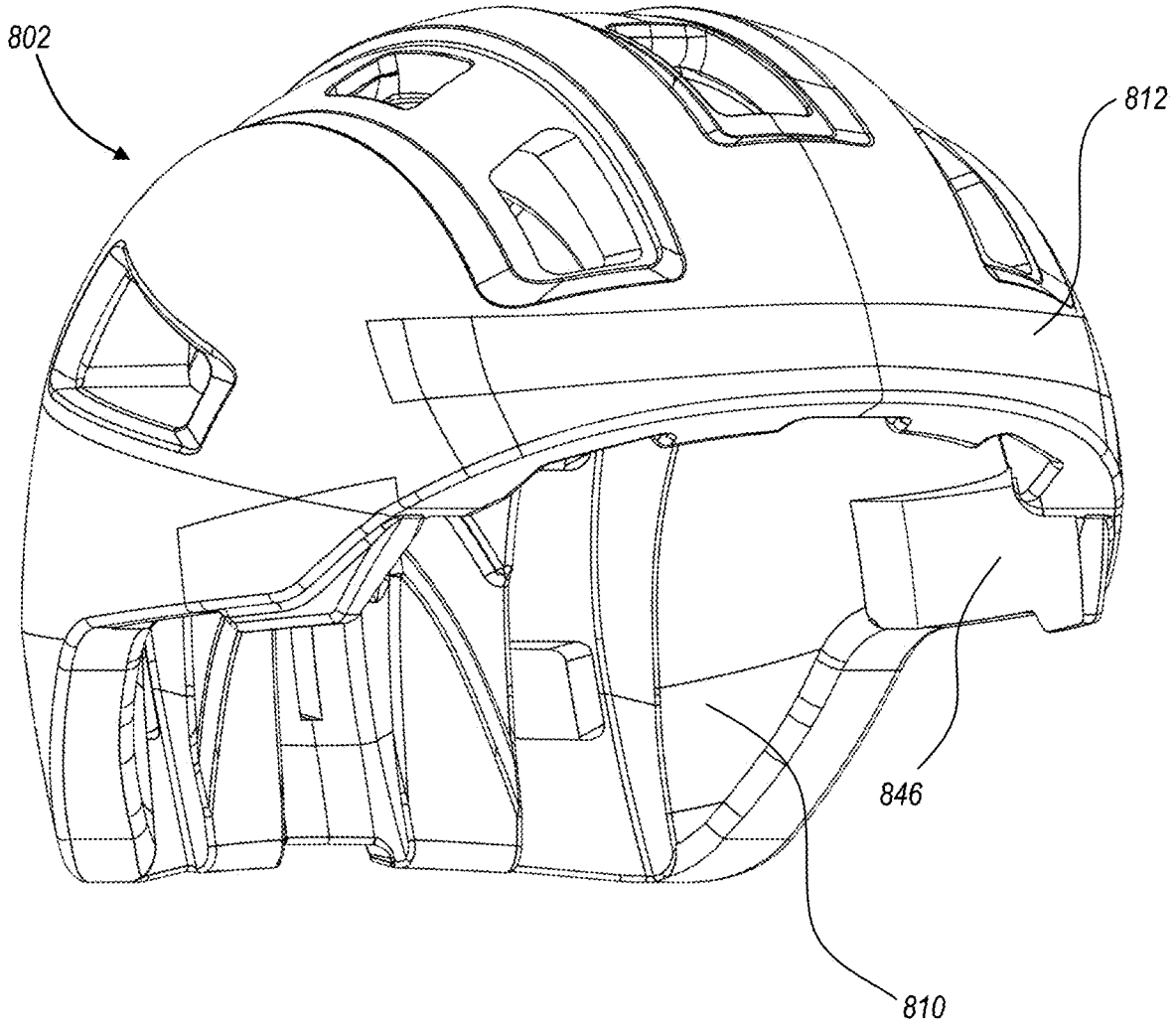
FIG. 11 schematically illustrates an embodiment of a helmet comprising recesses configured to receive housings of an adjustable helmet retention system.

FIG. 11 illustrates just the helmet shell 802 of FIG. 10. The helmet shell 802 includes recesses 846 configured to receive the housings 830 of the adjustable retention system 804 shown in FIG. 10.

Figure 12:
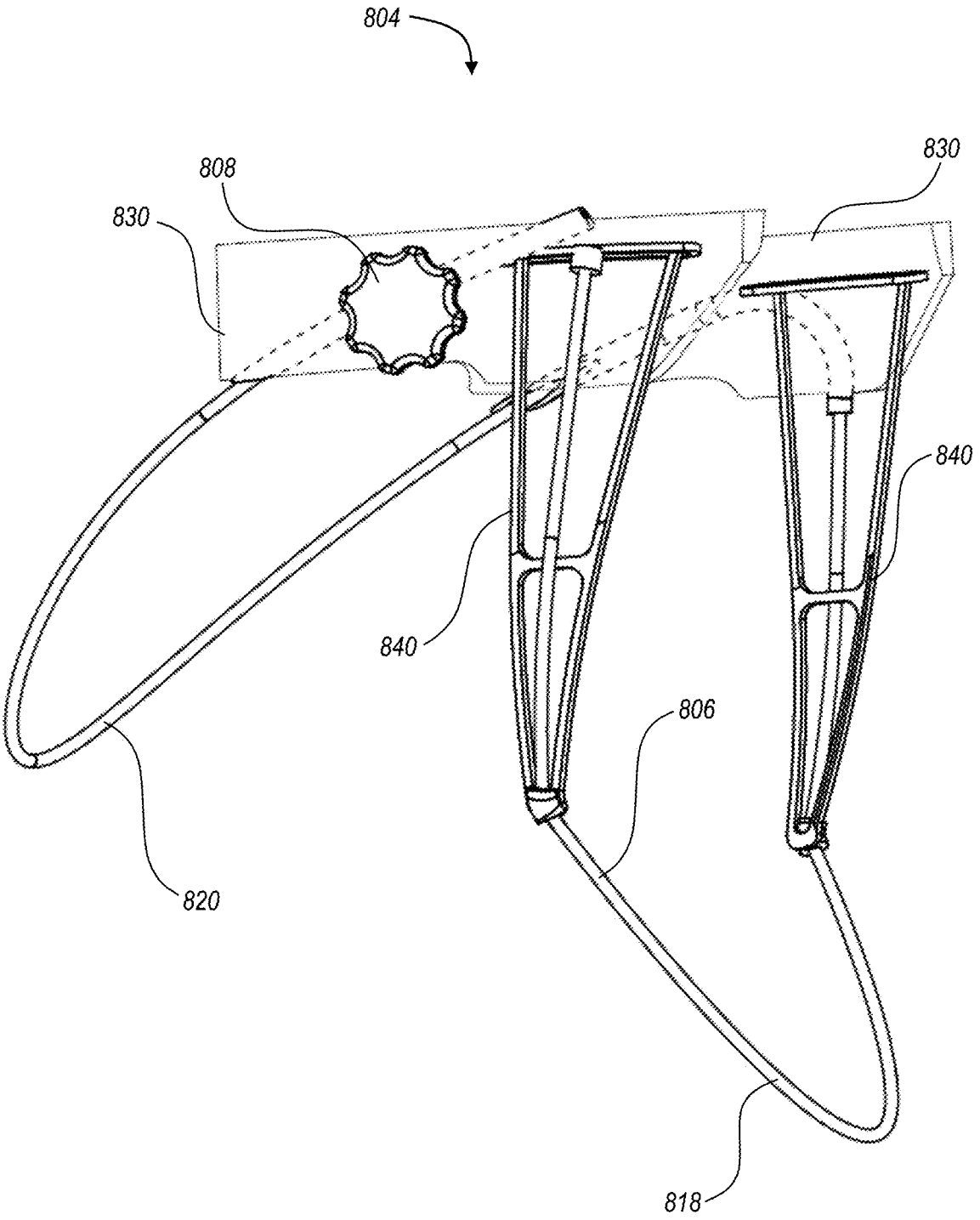
FIG. 12 schematically illustrates an embodiment of an adjustable helmet retention system comprising a truss pair and a housing pair.

FIG. 12 illustrates just the adjustable retention system 804 of FIG. 10, including a retention strap 806 comprising a chin strap subcomponent 818 and a fit strap subcomponent 820, an actuator 808, a truss pair 840, and two housings 830. An adjustable retention system 804 including housings 830 enables the system to be modular, allowing for quick insertion of the adjustable retention system 804 in various types of helmets and accelerating the assembly process of the helmet and retention assemblies during manufacture. Housings may also be included or combined with other embodiments of helmets and adjustable retention system 804 assemblies described to facilitate the assembly of the helmet 800.

Figure 13A:
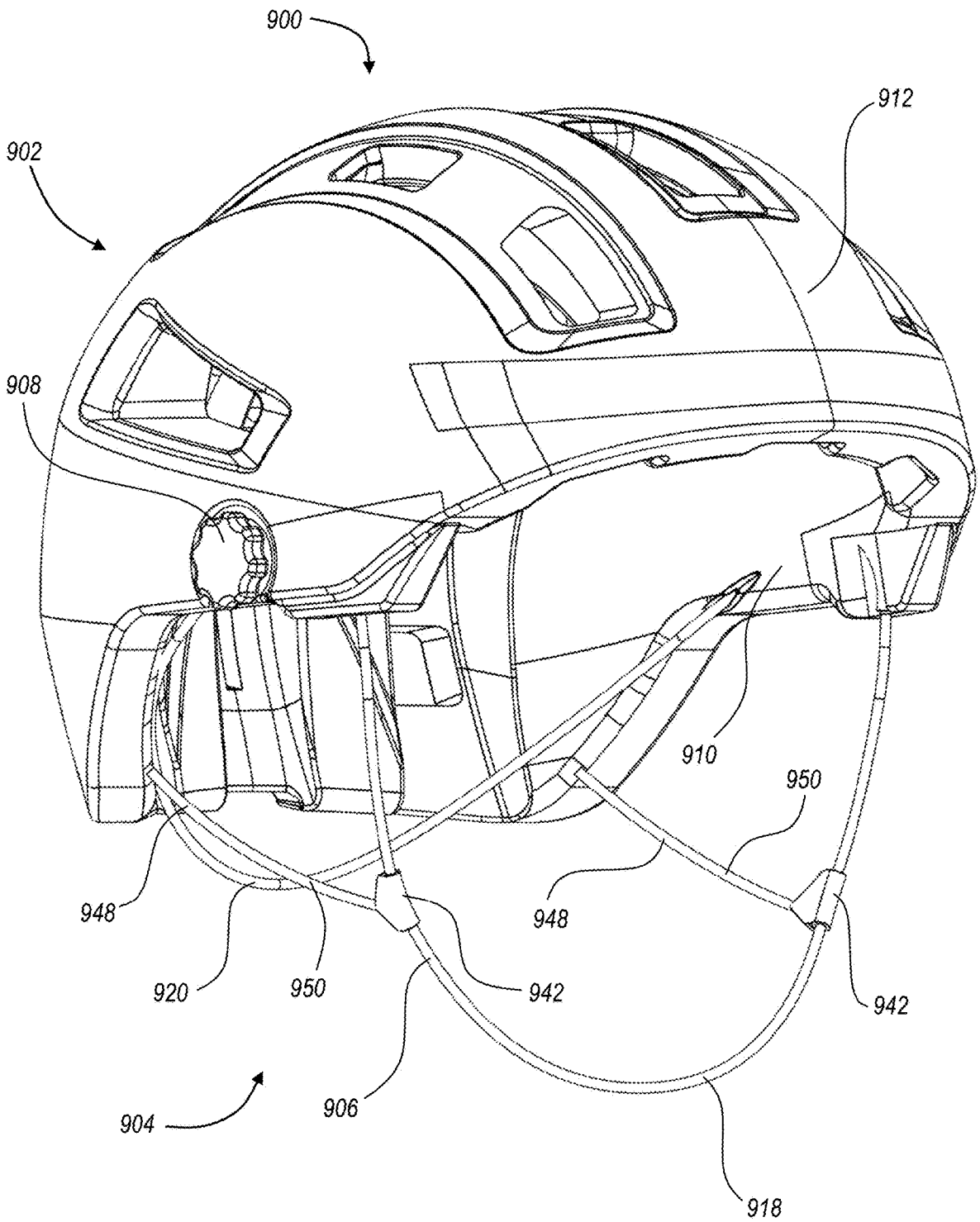
FIG. 13A schematically illustrates an embodiment of another helmet and adjustable retention assembly.

FIG. 13A illustrates an embodiment of a helmet and adjustable retention assembly 900, comprising a helmet shell 902 having an inner shell component 910 and an outer shell component 912 and an adjustable retention system 904. The adjustable retention system 904 comprises a retention strap 906 having a chin strap subcomponent 918 and a fit strap or fit strap cable subcomponent 920, an actuator 908, and one or more tethers 948, each tether 948 connected to the retention strap 906 and a portion of the helmet shell 902. The tethers 948 may comprise a cord or leash having rear arms 950 that engage the retention strap 906 at an anchor fitting 942. The tethers 948 enable proper geometric placement of the retention strap 906 and anchor fittings 942 on the wearer's head. Proper geometric placement of the retention strap 906 contributes to the safety and comfort of the helmet 900, particularly in "roll off" situations, where the helmet 900 is being pulled toward a front or back of the wearer's head. The retention strap 906 may be held at an angle (by the tethers 948) against a wearer's jaw in such a way that the retention strap 906 cannot be slid off the wearer's jaw or head without loosening the retention strap 906.

The tethers 948 may be constructed from the same material as the retention strap 906. In some embodiments, the rear arms 950 of the tethers 948 are connected to the helmet shell 902, such as to and/or between the inner and outer shell components 910, 912. The rear arms 950 may be configured to fit around or hang behind the wearer's ear, while the retention strap 906 may be configured to fit around or hang in front of the wearer's ear. In this way, the rear arms 950 stabilize the retention strap 906 while a wearer is using the helmet and adjustable retention system assembly 900.

Figure 13B:
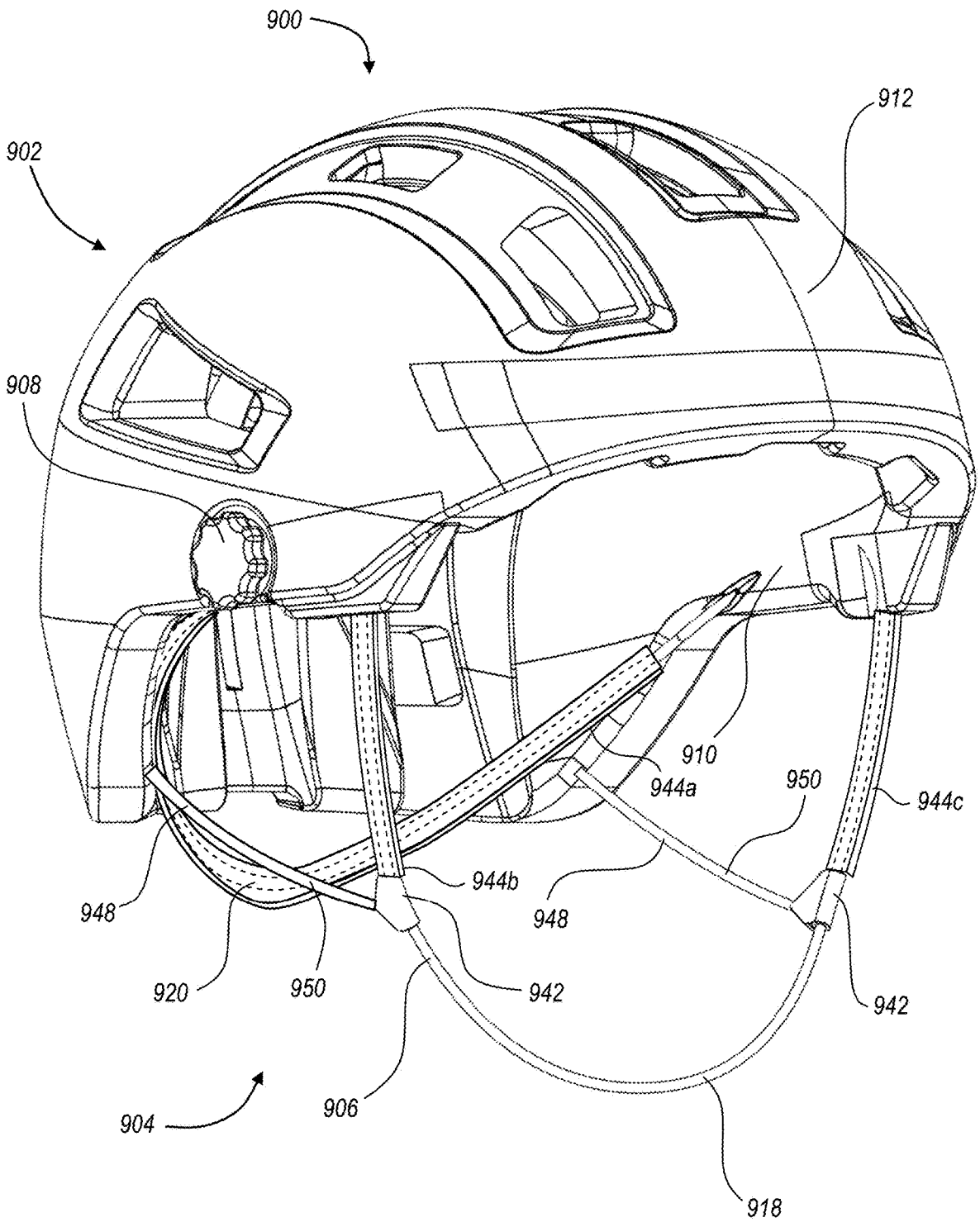
FIG. 13B schematically illustrates an embodiment of a helmet and an adjustable retention assembly that includes an adjustable retention cable and position retention sheaths for the adjustable retention cable.

FIG. 13B illustrates another embodiment of a helmet and adjustable retention assembly 900 having and an adjustable retention system 904, an adjustable retention strap comprising a retention cable 906, which includes a chin strap cable subcomponent 918 and a fit strap or fit strap cable subcomponent 920, and an actuator 908 operably connected to the retention cable 906 to adjust its length and tightness. This embodiment further includes a first position retention sheath 944*a* that encloses at least a portion of the fit strap or fit strap cable subcomponent 920, and second and third position retentions sheaths 944*b*, 944*c* that enclose a portion of left and right sides of the chin strap cable subcomponent 918. The first position retention sheath 944*a* helps maintain the fit strap or fit strap cable subcomponent 920 in a desired or relatively fixed position relative to the helmet shell 902, and the second and third position retention sheaths 944*b*, 944*c* help maintain the chin strap cable subcomponent 918 in a desired or relatively fixed position relative to the helmet shell 902. This assists the user to install and remove the helmet shell 902 from the user's head, such as by preventing the less stiff and more flaccid fit strap or fit strap cable subcomponent 920 and the less stiff and more flaccid chin strap cable subcomponent 918 from tangling or moving into positions that impede rather than facilitate installation and/or removal.

FIGS. 13C-13F schematically illustrate example position retention sheaths 1318A-1318D of different designs that provide different a different look and feel and possibly different levels of stiffness depending on the material used to make the position retention sheaths 1318A-1318D.

Figures 13C, 13D, 13E, 13F:
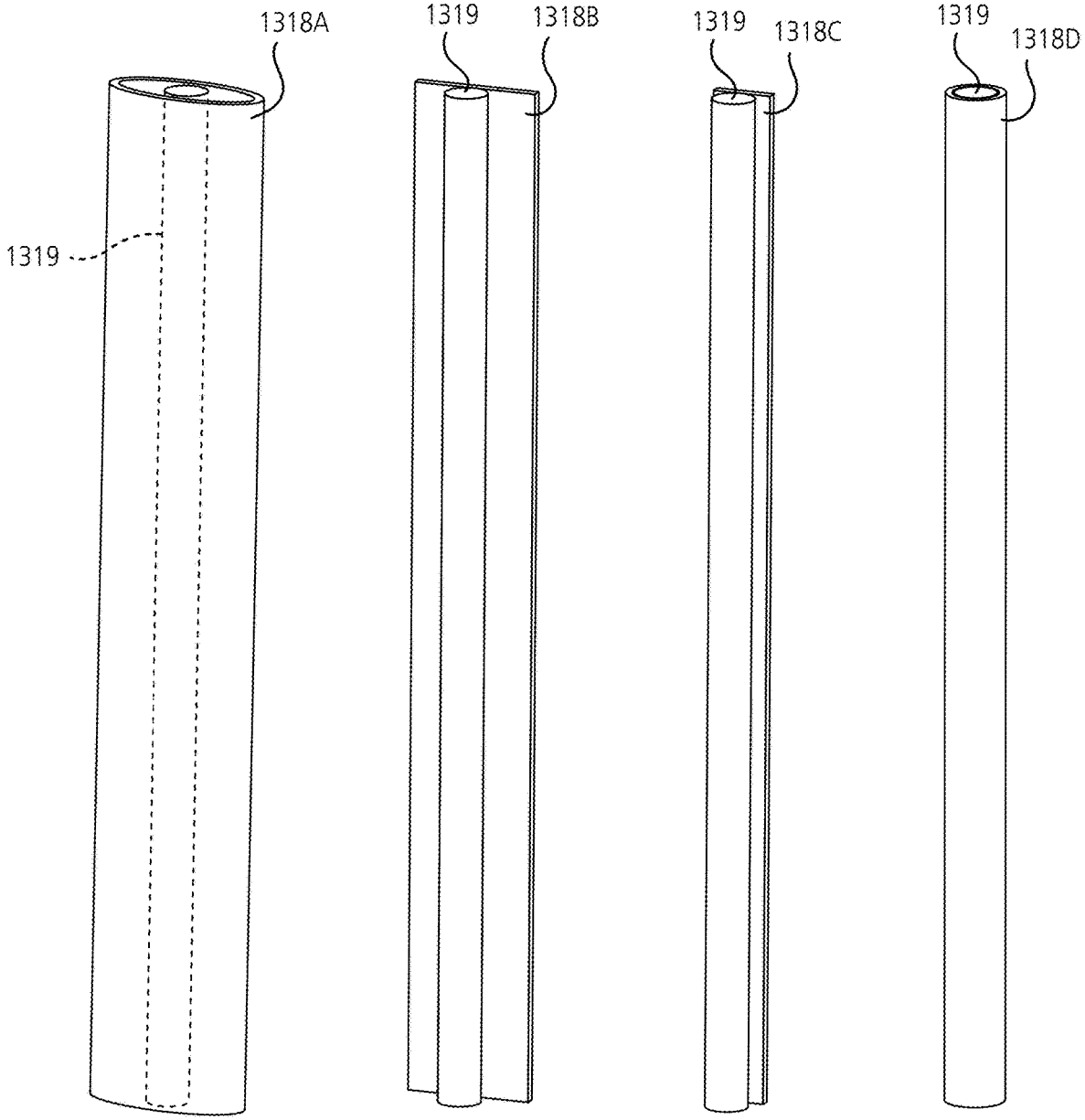
FIGS. 13C-13F schematically illustrate example position retention sheaths for maintaining the adjustable retention cable in a desired position relative to a protective helmet.

FIG. 13C schematically illustrates a position retention sheath 1318A having a generally oval cross section and a passageway 1319 for receiving therein at least a portion of a retention cable 906, including a chin strap cable subcomponent 918 and a fit strap or fit strap cable subcomponent 920. The volume between the outer wall forming the generally oval cross section and the passageway 1319 can be solid polymer or include one or more gaps therebetween to reduce mass and/or increase flexibility.

FIG. 13D schematically illustrates a position retention sheath 1318B having a generally rectangular wall and a tubular portion that provides a passageway 1319 for receiving therein at least a portion of a retention cable 906, including a chin strap cable subcomponent 918 and a fit strap or fit strap cable subcomponent 920. The generally rectangular wall and a tubular portion can be constructed from a polymer material in order to provide a desired balance of stiffness and rigidity. The generally rectangular wall can be oriented toward to user's face to provide a smooth surface and shield the face from the protruding tubular portion.

FIG. 13E schematically illustrates a position retention sheath 1318C having a generally rectangular wall and a tubular portion that provides a passageway 1319 for receiving therein at least a portion of a retention cable 906, including a chin strap cable subcomponent 918 and a fit strap or fit strap cable subcomponent 920. The difference between this embodiment and the embodiment of FIG. 13D is the size of the generally rectangular wall, which is smaller in FIG. 13E in order to provide a desired balance of stiffness and rigidity depending on the polymer material being used.

FIG. 13F schematically illustrates a position retention sheath 1318D having a tubular structure that provides a passageway 1319 for receiving therein at least a portion of a retention cable 906, including a chin strap cable subcomponent 918 and a fit strap or fit strap cable subcomponent 920. The cross-sectional thickness of the tubular structure can be selected to provide a desired balance of stiffness and rigidity depending on the polymer material being used. The tubular structure can provide a generally smooth, curved outer surface that provides comfort to the user.

The position retention sheaths 1318A-1318D are advantageously formed from a polymer material that, when made into a sheath of desired cross section, will provide a desired level of stiffness in order to retain the retention cable 906, including the chin strap cable subcomponent 918 and the fit strap or fit strap cable subcomponent 920, in a desired position relative to the helmet shell 902. While the term "stiffness" is used, it will be understood that the position retention sheaths 1318A-1318D need only be stiffer than the retention cable 906, including the chin strap cable subcomponent 918 and the fit strap or fit strap cable subcomponent 920, in order to remain in a desired position relative to the helmet shell 902. Thus, the position retention sheaths 1318A-1318D can also be somewhat flexible and not be overly rigid in order to provide a balance between comfort to the user and the ability to retain the retention cable 906, including the chin strap cable subcomponent 918 and the fit strap or fit strap cable subcomponent 920, in a desired position relative to the helmet shell 902. Thus, the polymer material can have a desired balance between rigidity and flexibility to ensure proper positioning of the retention cable 906, including the chin strap cable subcomponent 918 and the fit strap or fit strap cable subcomponent 920, relative to the helmet shell 902 while, at the same time, providing comfort to the user.

Figure 14:
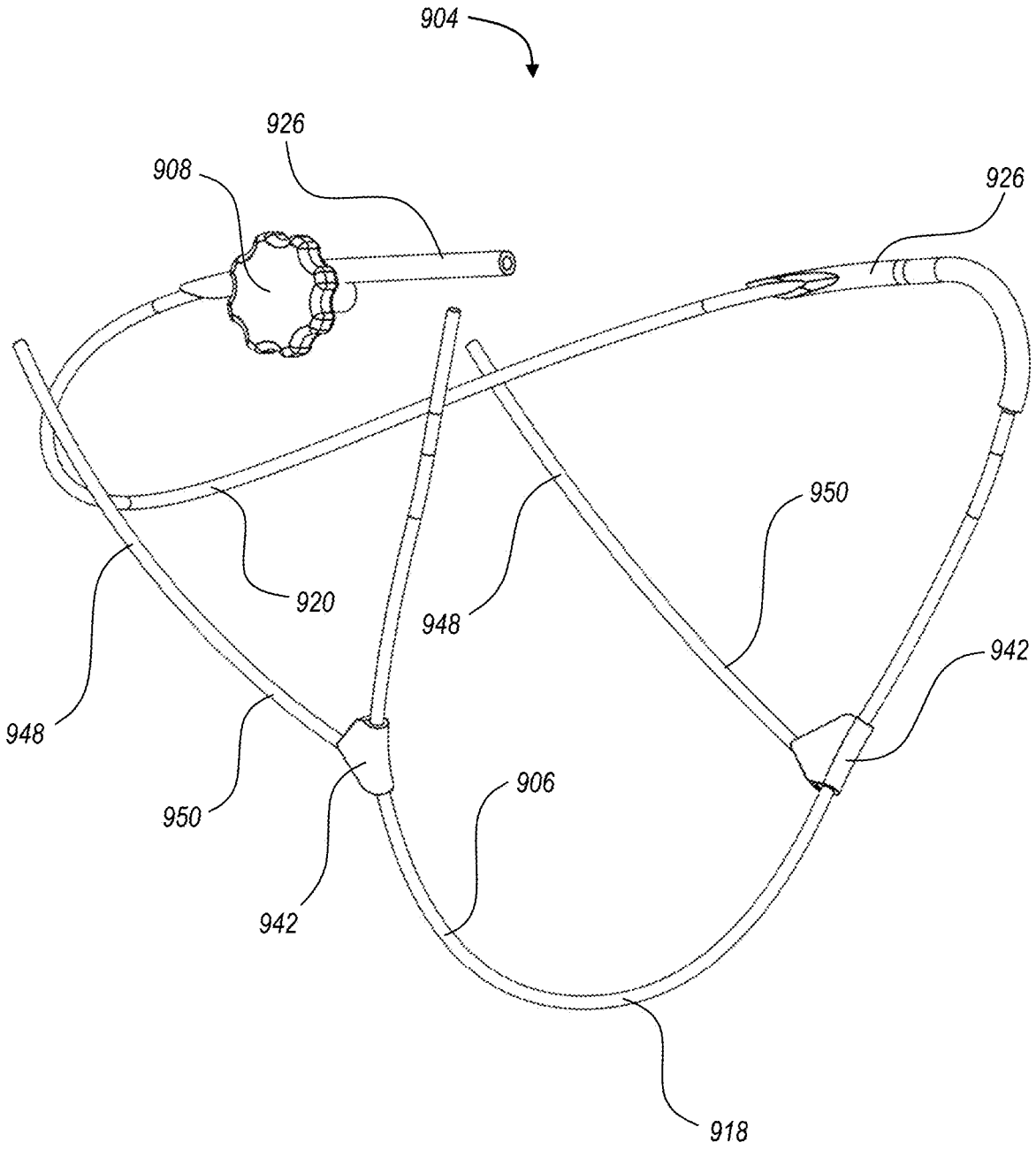
FIG. 14 schematically illustrates another embodiment of an adjustable helmet retention system comprising tethers.

FIG. 14 illustrates the adjustable retention system 904 of FIG. 13, including a retention strap 906 comprising a chin strap subcomponent 918 and a fit strap or fit strap cable subcomponent 920, an actuator 908, anchor sleeves 926, and the tethers 948. The anchor fitting 942 may be slidable along the retention strap 906. This may contribute to a more comfortable and secure fit of the retention strap 906 and the helmet shell 902. In some embodiments, the anchor fittings 942 may include a lock, latch, or clamping means that will maintain a position of the anchor fittings 942 along the retention strap 906.

In some embodiments, the tethers 948 can be semi-rigid. In some embodiments, the tethers 948 can be a continuous extension of the retention strap 906. In some embodiments, the retention strap 906, and not the tethers 948, may extend behind a wearer's ear where the retention strap 906 attaches to or interfaces with a rear portion of the helmet shell 902. In such embodiments, the actuator 908 may be positioned further to the rear of the helmet 900 to engage the retention strap 906. The tethers 948 may be attached to the retention strap 906 in a manner similar to that described above. Additionally, the tethers 948 may extend from the retention strap 906 in front of the wearer's ears to attach to or interface with the helmet shell 902.

Figure 15:
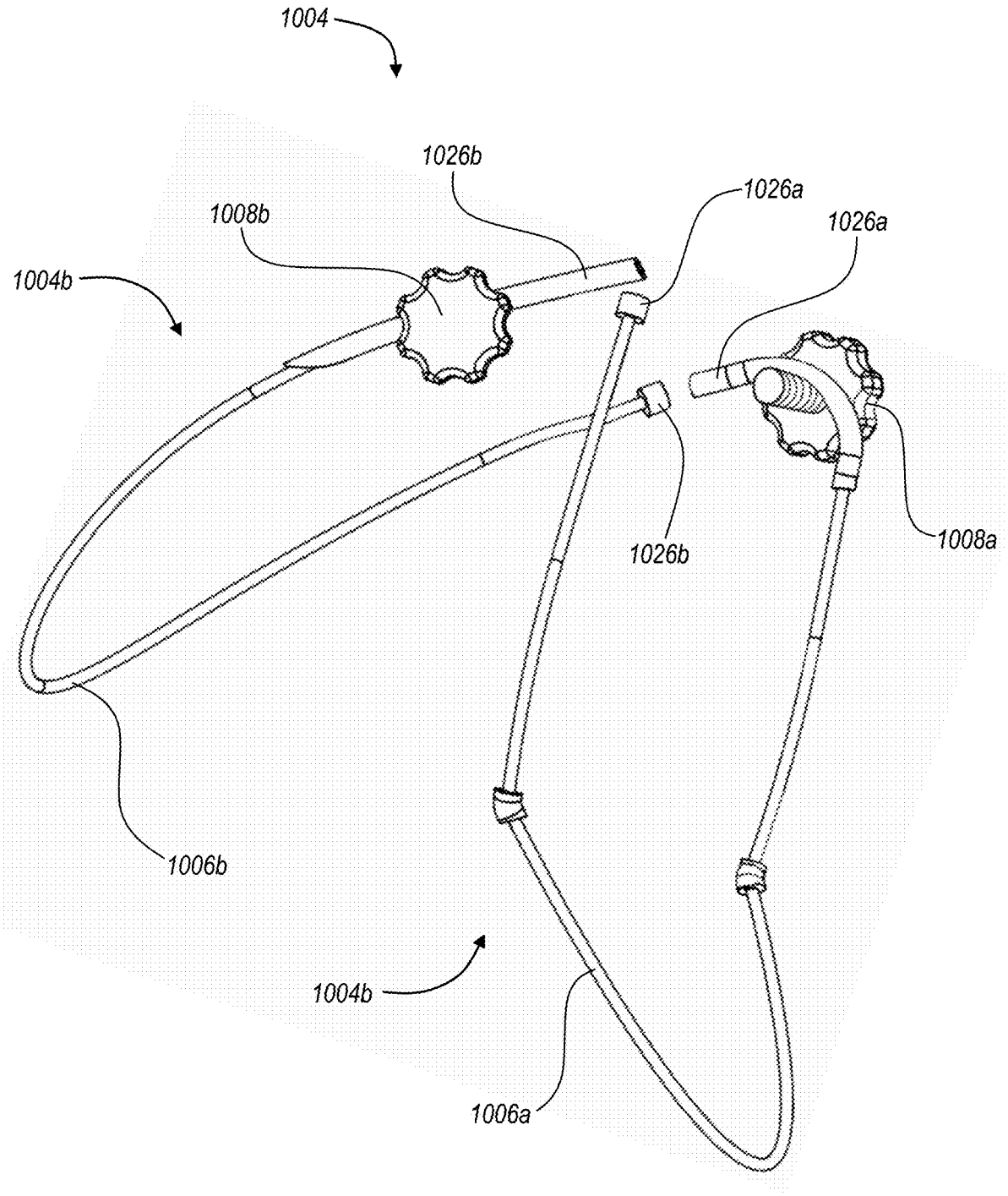
FIG. 15 schematically illustrates another embodiment of an adjustable helmet retention system comprising an adjustable chin strap component and an adjustable fit strap component.

FIG. 15 illustrates an embodiment of an adjustable retention system 1004 comprising two retention sub-systems, including an adjustable chin strap subcomponent 1004*a* and an adjustable fit strap subcomponent 1004*b*. The adjustable chin strap subcomponent 1004*a* may be configured to pull a helmet shell tight against the top of the wearer's head and secure the helmet in place. The adjustable chin strap subcomponent 1004*a* may comprise a chin strap 1006*a*, a first actuator 1008*a*, and one or more chin strap anchor sleeves 1026*a*. The chin strap 1006*a* may be formed from the same or similar materials as the retention strap or retention strap cable 106 of previous embodiments. The first actuator 1008*a* and chin strap anchor sleeves 1026*a* may function in a similar manner as described in previous embodiments to secure the chin strap 1006*a* to an exemplary helmet shell and adjust the tightness and comfort of the chin strap 1006*a*.

The adjustable fit strap subcomponent 1004*b* is configured to pull the wearer's head tight against an inner surface of an exemplary helmet, ensuring a comfortable fit and/or helping to prevent a helmet shell from twisting off the wearer's head during an impact. The adjustable fit strap subcomponent 1004*b* may comprise a fit strap 1006*b*, a second actuator 1008*b*, and one or more fit strap anchor sleeves 1026*b*. The fit strap 1006*b* may also be formed from the same or similar materials as the retention strap or retention strap cable 106 of previous embodiments. The second actuator 1008*b* and fit strap anchor sleeves 1026*b* may also function in a similar manner as actuators and anchor sleeves described in previous embodiments to secure the fit strap 1006*b* to a helmet shell and adjust the tightness and comfort of the fit strap 1006*b*.

The first and second actuators 1008*a*, 1008*b* of the adjustable chin strap subcomponent 1004*a* and adjustable fit strap subcomponent 1004*b*, respectively, may each be placed on a left or right ear area of a helmet shell. Preferably, the first and second actuators 1008*a*, 1008*b* are placed on opposite sides of a helmet shell, as illustrated in FIG. 15, to mitigate a wearer's confusion as to which sub-system 1004*a* or 1004*b* an actuator 1008*a* or 1008*b* may make an adjustment. In some embodiments, the first and second actuators 1008*a*, 1008*b* may receive particular placement to facilitate an association in the wearer's mind between an actuator 1008*a* or 1008*b* and a sub-system 1004*a* or 1004*b*. For example, the first actuator 1008*a* of the adjustable chin strap subcomponent 1004*a* may be placed closer to a bottom edge of a helmet shell, and thus closer to the chin strap 1006*a*, to facilitate an association between the first actuator 1008*a* and the chin strap 1006*a*. Similarly, the second actuator 1008*b* of the adjustable fit strap subcomponent 1004*b* may be placed closer to a rear portion of a helmet shell, and thus closer to the fit strap 1006*b*, to facilitate an association between the second actuator 1008*b* and the fit strap 1006*b*.

Figure 16:
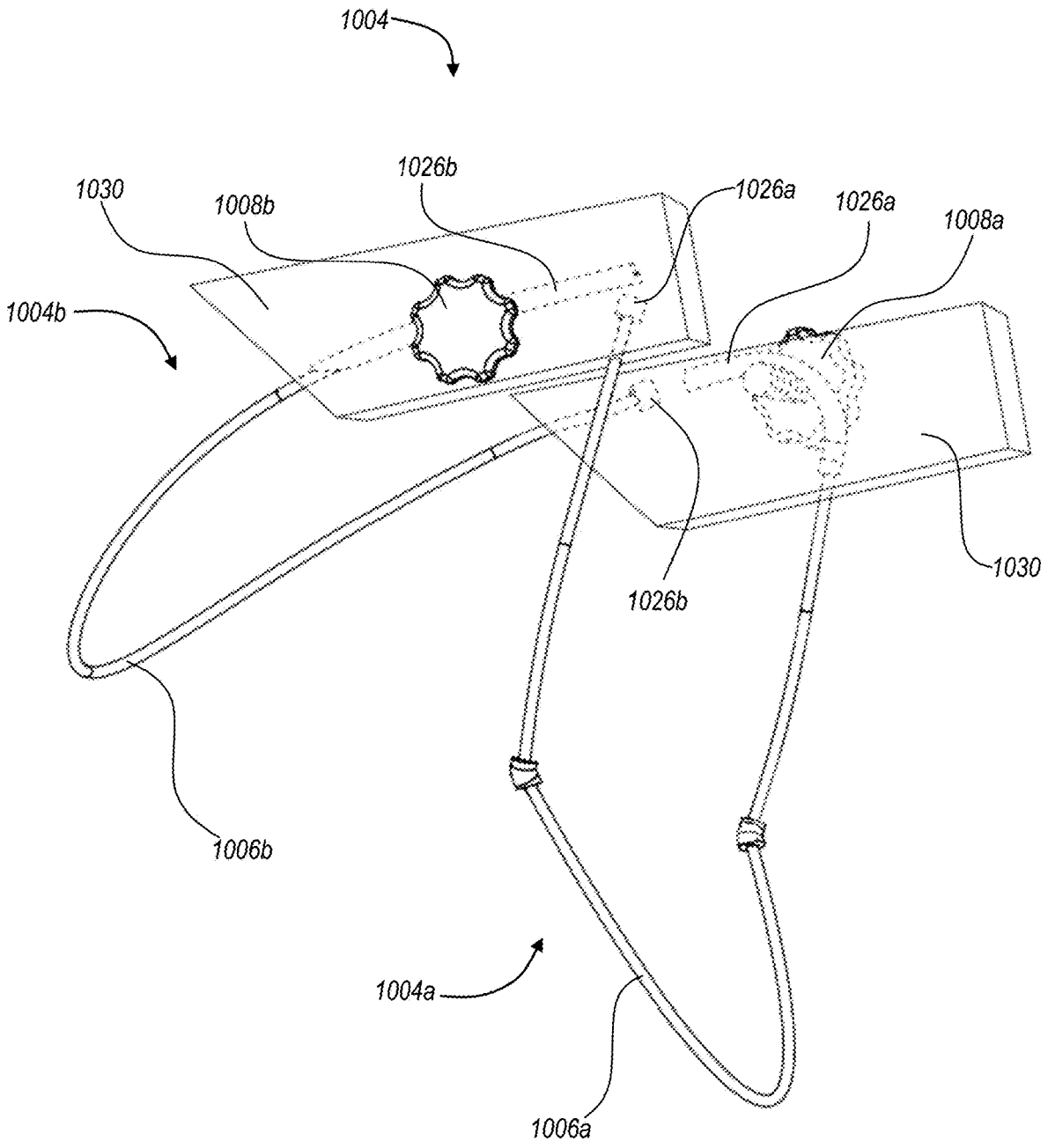
FIG. 16 schematically illustrates another embodiment of an adjustable helmet retention system comprising an adjustable chin strap retention component and an adjustable fit strap component attached to a housing pair.

FIG. 16 illustrates an adjustable retention system 1004 comprising two subcomponents, including an adjustable chin strap subcomponent 1004*a* and an adjustable fit strap subcomponent 1004*b*, and two housings 1030 configured to receive the adjustable chin strap subcomponent 1004*a* and the adjustable fit strap subcomponent 1004*b*. An adjustable retention system 1004 thus configured with housings 1030 may enable faster and easier assembly of the sub-systems 1004*a*, 1004*b* into a helmet.

Additional Terms & Definitions

While certain embodiments of the present disclosure have been described in detail, with reference to specific configurations, parameters, components, elements, etcetera, the descriptions are illustrative and are not to be construed as limiting the scope of the claimed invention.

Furthermore, it should be understood that for any given element of component of a described embodiment, any of the possible alternatives listed for that element or component may generally be used individually or in combination with one another, unless implicitly or explicitly stated otherwise.

In addition, unless otherwise indicated, numbers expressing quantities, constituents, distances, or other measurements used in the specification and claims are to be understood as optionally being modified by the term "about" or its synonyms. When the terms "about," "approximately," "substantially," or the like are used in conjunction with a stated amount, value, or condition, it may be taken to mean an amount, value or condition that deviates by less than 20%, less than 10%, less than 5%, less than 1%, less than 0.1%, or less than 0.01% of the stated amount, value, or condition. At the very least, and not as an attempt to limit the application of the doctrine of equivalents to the scope of the claims, each numerical parameter should be construed in light of the number of reported significant digits and by applying ordinary rounding techniques.

Any headings and subheadings used herein are for organizational purposes only and are not meant to be used to limit the scope of the description or the claims.

It will also be noted that, as used in this specification and the appended claims, the singular forms "a," "an" and "the" do not exclude plural referents unless the context clearly dictates otherwise. Thus, for example, an embodiment referencing a singular referent (e.g., "widget") may also include two or more such referents.

It will also be appreciated that embodiments described herein may also include properties and/or features (e.g., ingredients, components, members, elements, parts, and/or portions) described in one or more separate embodiments and are not necessarily limited strictly to the features expressly described for that particular embodiment. Accordingly, the various features of a given embodiment can be combined with and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include such features.

What is claimed is:

1. A helmet and adjustable retention assembly, comprising:

a helmet configured to at least partially cover a wearer's head, wherein the helmet includes:

a helmet shell, the helmet shell comprising:

a front and a back;

a left side region and a right side region;

a first channel, groove, space, conduit, or duct in the left side region of the helmet shell; and a second channel, groove, space, conduit, or duct in the right side region of the helmet shell; and an adjustable retention system including:

one or more retention straps or cables including a chin strap or chin strap cable subcomponent configured to engage a wearer's chin and a fit strap or fit strap cable subcomponent configured to engage a wearer's head, wherein one or more first portions of the one or more retention straps or retention cables pass through the first channel, groove, space, conduit, or duct in the left side region of the helmet shell, and wherein one or more second portions of the one or more retention straps or cables pass through the second channel, groove, space, conduit, or duct in the right side region of the helmet shell; and one or more actuators configured to attach to the left and/or right side regions of the helmet shell and be operably connected to the one or more retention straps or retention cables so that actuating said one or more actuators selectively increases or decreases a length of the corresponding retention strap or cable in order to selectively loosen or tighten the retention strap or cable, respectively, relative to the wearer's chin and/or head.

2. The helmet and adjustable retention assembly of claim 1, wherein the one or more actuators comprise:

a chin strap actuator operably connected to the chin strap or chin strap cable subcomponent and configured to selectively shorten or lengthen the chin strap or chin strap cable subcomponent in order to selectively tighten or loosen the chin strap or chin strap cable subcomponent relative to the wearer's chin; and a fit strap actuator separate from the chin strap actuator, operably connected to the fit strap or fit strap cable subcomponent, and configured to selectively shorten or lengthen the fit strap or fit strap cable subcomponent in order to selectively tighten or loosen the fit strap or fit strap cable subcomponent relative to the wearer's head.

3. The helmet and adjustable retention assembly of claim 1, wherein the one or more retention straps or cables comprise a continuous retention strap or a continuous retention cable that includes the chin strap or chin strap cable subcomponent configured to engage a wearer's chin and the fit strap or fit strap cable subcomponent configured to engage the wearer's head, wherein the one or more actuators comprise an actuator operably connected to the continuous retention strap or continuous retention cable and configured to selectively shorten or lengthen the continuous retention strap or continuous retention cable in order to selectively tighten or loosen the continuous retention strap or continuous retention cable relative to the wearer's chin and head.

4. The helmet and adjustable retention assembly of claim 3, wherein the continuous retention cable comprises either a single-stranded cable or a dual-stranded cable, wherein when the continuous retention cable comprises a dual-stranded cable, the helmet further comprises a length-equalizing wheel disposed on or in the helmet shell.

5. The helmet and adjustable retention assembly of claim 4, further comprising one or more retention sheaths that at least partially enclose at least one of the chin strap cable subcomponent or the fit strap cable subcomponent, wherein the one or more retention sheaths are stiffer than the chin strap cable subcomponent and the fit strap cable subcomponent in order to maintain at least one of the chin strap cable subcomponent or the fit strap cable subcomponent in a desired position relative to the helmet shell.

6. The helmet and adjustable retention assembly of claim 1, wherein the one or more actuators each comprises a slider, detent, spring pump, ratchet system, wheel, or pinion gear for selectively increasing or decreasing the length of the one or more retention straps or cables.

7. The helmet and adjustable retention assembly of claim 1, wherein at least one of the one or more retention straps or cables includes a linear gear and at least one of the one or more actuators includes a pinion gear operably connected to the linear gear such that selectively rotating the actuator in a first direction shortens the retention strap or cable and rotating the actuator in an opposite direction lengthens the retention strap or cable.

8. The helmet and adjustable retention assembly of claim 1, wherein the first channel, groove, space, conduit, or duct and the second channel, groove, space, conduit, or duct receive the one or more first portions and the one or more second portions of the one or more retention straps or cables when shortened or lengthened by the one or more actuators.

9. The helmet and adjustable retention assembly of claim 1, further comprising a truss pair, including a first truss attached to the left side region of the helmet and second truss attached to the right side region of the helmet, wherein each truss is configured to support a length of the one or more retention straps or cables, including the chin strap or a chin strap subcomponent.

10. The helmet and adjustable retention assembly of claim 1, further comprising one or more tethers configured to connect a portion of the one or more retention straps or cables to a rear portion of the helmet.

11. The helmet and adjustable retention assembly of claim 1, further comprising one or more housings connected to the one or more retention straps or cables and the one or more actuators so as to form an adjustable retention system, the one or more housings each configured as an insert that connects to a corresponding recess in the helmet.

12. A helmet and adjustable retention assembly, comprising:

a helmet configured to at least partially cover a wearer's head, wherein the helmet includes:

a helmet shell, the helmet shell comprising:

a front and a back;

a left side region and a right side region;

a first channel, groove, space, conduit, or duct in the left side region of the helmet shell; and a second channel, groove, space, conduit, or duct in the right side region of the helmet shell; and an adjustable retention system including:

one or more retention straps or cables attached to the helmet shell of the helmet and including a chin strap or chin strap cable subcomponent configured to engage a wearer's chin and a fit strap or fit strap cable subcomponent configured to engage a wearer's head;

a chin strap actuator attached to a first side region of the helmet shell operably connected to the chin strap or chin strap cable subcomponent, and configured to selectively shorten or lengthen the chin strap or chin strap cable subcomponent in order to selectively tighten or loosen the chin strap or chin strap cable subcomponent relative to the wearer's chin; and a fit strap actuator attached to a second side region of the helmet shell, operably connected to the fit strap or fit strap cable subcomponent, and configured to selectively shorten or lengthen the fit strap or fit strap cable subcomponent in order to selectively tighten or loosen the fit strap or fit strap cable subcomponent relative to the wearer's head, wherein tightening the fit strap or fit strap cable subcomponent urges the wearer's head against a front inner surface of the helmet shell.

13. The helmet and adjustable retention assembly of claim 12, wherein the one or more retention straps or cables comprise a continuous retention strap or a continuous retention cable that includes the chin strap or chin strap cable subcomponent configured to engage a wearer's chin and the fit strap or fit strap cable subcomponent configured to engage the wearer's head.

14. The helmet and adjustable retention assembly of claim 13, wherein the continuous retention cable comprises either a single-stranded cable or a dual-stranded cable, wherein when the continuous retention cable comprises a dual-stranded cable, the helmet further comprises a length-equalizing wheel configured to be disposed on or in a helmet shell of a protective helmet.

15. The helmet and adjustable retention assembly of claim 14, further comprising a first retention sheath extending below the left side region of the helmet shell and a second retention sheath extending below the right side region of the helmet shell, wherein the first and second retention sheaths at least partially enclose at least one of the chin strap cable subcomponent or the fit strap cable subcomponent, wherein the one or more retention sheaths are stiffer than the chin strap cable subcomponent and the fit strap cable subcomponent in order to maintain at least one of the chin strap cable subcomponent or the fit strap cable subcomponent in a desired position relative to a helmet shell of a protective helmet.

16. The helmet and adjustable retention assembly of claim 12, wherein the chin strap actuator and the fit strap actuator each comprises a slider, detent, spring pump, ratchet system, wheel, or pinion gear for selectively increasing or decreasing the length of the one or more retention straps or cables.

17. The helmet and adjustable retention assembly of claim 12, further comprising a truss pair, including a first truss attached to the left side region of the helmet shell and a second truss attached to the right side region of the helmet shell, wherein each truss is configured to support a length of the one or more retention straps or cables, including the chin strap or chin strap cable subcomponent.

18. The helmet and adjustable retention system of claim 12, wherein the fit strap or fit strap cable subcomponent is configured to engage only a rear region of the wearer's head.

19. An adjustable helmet retention system for use with a protective helmet, comprising:

a retention strap or cable configured to attach to a helmet shell and secure the protective helmet to wearer's head and engage the wearer's chin and head, the retention strap or cable comprising:

a chin strap subcomponent configured to attach to the helmet shell, engage a wearer's chin, and having two opposing ends, a first end configured to attach to a left side region of the helmet shell and a second end configured to attach to a right side region of the helmet shell;

a fit strap subcomponent configured to attach to the helmet shell, engage an occipital region or portion of a wearer's head, and having two opposing ends, a first end configured to attach to the left side region of the helmet shell and a second end configured to attach to the right side region the helmet shell, wherein one of the opposing ends of the chin strap subcomponent is connected to one of the opposing ends of the fit subcomponent to form the retention strap or cable; and an actuator configured to attach to the left or right side region of the helmet shell and be operably connected to the retention strap or cable so that actuating the actuator selectively increases or decreases a length of the retention strap or cable in order to selectively loosen or tighten the retention strap or cable, respectively, relative to the wearer's chin and head.

20. A helmet comprising a helmet shell and the adjustable helmet retention system of claim 19, wherein the helmet includes one or more channels, grooves, spaces, conduits, or ducts configured to receive a portion of the retention strap or cable when shortened or lengthened by the actuator.

* * * * *